US008468764B2

(12) United States Patent
Degen et al.

(10) Patent No.: US 8,468,764 B2
(45) Date of Patent: Jun. 25, 2013

(54) LOAD BEARING WALL FORMWORK SYSTEM AND METHOD

(75) Inventors: Ronald Jean Degen, Santiago (CL); Fausto Bejarano Castillo, San Jose (CR); Pablo Rodriguez Acosta, San Jose (CR); Humberto Trimino Vasquez, San Jose (CR)

(73) Assignee: The Plycem Company Inc., Cartago (CR)

( * ) Notice: Subject to any disclaimer, the term of this patent is extended or adjusted under 35 U.S.C. 154(b) by 0 days.

(21) Appl. No.: 13/170,980

(22) Filed: Jun. 28, 2011

(65) Prior Publication Data

US 2011/0314760 A1 Dec. 29, 2011

Related U.S. Application Data

(63) Continuation of application No. 11/856,528, filed on Sep. 17, 2007, now abandoned.

(60) Provisional application No. 60/826,283, filed on Sep. 20, 2006.

(51) Int. Cl.

| | |
|---|---|
| ***E04B 2/30*** | (2006.01) |
| ***E04B 1/02*** | (2006.01) |
| *E04C 5/00* | (2006.01) |

(52) U.S. Cl.

USPC ..... 52/489.1; 52/426; 52/430; 52/568; 52/699

(58) Field of Classification Search

USPC ..... 52/425, 426, 427, 430, 431, 432, 52/489.1, 561, 562, 568, 699, 571

See application file for complete search history.

(56) References Cited

U.S. PATENT DOCUMENTS

| | | | | | |
|---|---|---|---|---|---|
| 1,052,788 | A | * | 2/1913 | Bates | 52/293.1 |
| 1,616,977 | A | * | 2/1927 | Koivu | 52/426 |
| 1,762,099 | A | * | 6/1930 | Phillips | 52/564 |
| 1,833,875 | A | * | 11/1931 | Lockwood | 52/410 |
| 2,061,281 | A | * | 11/1936 | Lawlor | 52/563 |

(Continued)

FOREIGN PATENT DOCUMENTS

| | | |
|---|---|---|
| ES | 2063634 | 3/1992 |
| GB | 1277816 | 6/1972 |

(Continued)

*Primary Examiner* — Brian Glessner
*Assistant Examiner* — Joseph J Sadlon
(74) *Attorney, Agent, or Firm* — Dorsey & Whitney LLP; Nathaniel P. Longley, Esq.

(57) ABSTRACT

A load bearing wall formwork system and method are disclosed. The load bearing wall formwork system comprises a unique clip assembly for joining two or more substantially planar structures, such as a wall panel, in a spaced apart manner and providing a space there between for placement of a flowable material. The clip assembly comprises a first clip member having a first side for attachment to the wall panel, a second side and an opening positioned between the first and second sides, as well as a second clip member, engageable with the first clip member, having a first side for attachment to a second wall panel, a second side and an opening positioned between the first and second sides. The openings provided in the first and second clip members are aligned when the clip members are engaged. A connecting member is insertable into the aligned openings of the first and second clip members, connecting the first and second clip members together. A wall formed by the foregoing components and a method of assembling a wall formwork are also disclosed.

23 Claims, 17 Drawing Sheets

U.S. PATENT DOCUMENTS

| | | | | | |
|---|---|---|---|---|---|
| 3,160,245 | A | * | 12/1964 | Pavlecka | 52/275 |
| 3,191,726 | A | * | 6/1965 | Pavlecka | 52/275 |
| 3,238,684 | A | | 3/1966 | Wood | |
| 3,383,817 | A | * | 5/1968 | Gregorl | 52/309.11 |
| 3,530,634 | A | * | 9/1970 | Adams | 52/687 |
| 3,552,076 | A | | 1/1971 | Gregorl | |
| 3,788,020 | A | * | 1/1974 | Gregori | 52/309.12 |
| 3,922,833 | A | * | 12/1975 | Eaton | 16/257 |
| 3,959,940 | A | * | 6/1976 | Ramberg | 52/348 |
| 4,203,788 | A | | 5/1980 | Clear | |
| 4,223,501 | A | * | 9/1980 | DeLozier | 52/309.12 |
| 4,231,203 | A | * | 11/1980 | Mikkelsen et al. | 52/284 |
| 4,433,520 | A | * | 2/1984 | Maschhoff | 52/275 |
| 4,741,139 | A | | 5/1988 | Campbell | |
| 4,773,199 | A | * | 9/1988 | Kohara | 52/426 |
| 4,889,310 | A | | 12/1989 | Boeshart | |
| 5,035,099 | A | * | 7/1991 | Lapish | 52/713 |
| 5,086,600 | A | * | 2/1992 | Holland et al. | 52/592.6 |
| 5,107,648 | A | | 4/1992 | Roby | |
| 5,235,791 | A | | 8/1993 | Yaguchi | |
| 5,337,534 | A | * | 8/1994 | Nasca | 52/745.21 |
| 5,448,866 | A | | 9/1995 | Saito et al. | |
| 5,459,970 | A | * | 10/1995 | Kim | 52/424 |
| 5,596,855 | A | * | 1/1997 | Batch | 52/309.11 |
| 5,611,183 | A | * | 3/1997 | Kim | 52/426 |
| 5,695,676 | A | | 12/1997 | Lee | |
| 5,704,180 | A | * | 1/1998 | Boeck | 52/426 |
| 5,761,866 | A | | 6/1998 | Maylon | |
| 5,782,050 | A | * | 7/1998 | Boeshart | 52/426 |
| 5,809,728 | A | * | 9/1998 | Tremelling | 52/426 |
| 5,857,300 | A | | 1/1999 | Gates | |
| 5,881,524 | A | * | 3/1999 | Ellison, Jr. | 52/565 |
| 5,918,427 | A | | 7/1999 | VanderWerf | |
| 5,930,970 | A | | 8/1999 | De Le fevre | |
| 5,956,922 | A | * | 9/1999 | Liuska | 52/745.09 |
| 6,076,323 | A | * | 6/2000 | Chiu | 52/562 |
| 6,151,856 | A | * | 11/2000 | Shimonohara | 52/426 |
| D435,212 | S | * | 12/2000 | Philippe | D8/354 |
| 6,231,024 | B1 | * | 5/2001 | Kugimiya et al. | 249/33 |
| 6,247,280 | B1 | * | 6/2001 | Grinshpun et al. | 52/309.12 |
| 6,263,631 | B1 | | 7/2001 | Nisbett et al. | |
| 6,352,237 | B1 | * | 3/2002 | Severino | 249/194 |
| 6,397,552 | B1 | * | 6/2002 | Bourque | 52/712 |
| 6,481,178 | B2 | * | 11/2002 | Moore, Jr. | 52/741.13 |
| 6,536,172 | B1 | * | 3/2003 | Amend | 52/426 |
| 6,681,539 | B2 | * | 1/2004 | Yost et al. | 52/309.11 |
| 6,865,857 | B1 | | 3/2005 | Adell Argiles | |
| 6,880,308 | B2 | | 4/2005 | Seiz et al. | |
| 6,892,498 | B1 | * | 5/2005 | Roman | 52/79.5 |
| 6,895,720 | B2 | | 5/2005 | Keith | |
| 6,931,806 | B2 | * | 8/2005 | Olsen | 52/309.11 |
| 6,935,081 | B2 | * | 8/2005 | Dunn et al. | 52/426 |
| 7,082,732 | B2 | * | 8/2006 | Titishov | 52/426 |
| 7,160,061 | B2 | | 1/2007 | Nickelson et al. | |
| 7,188,747 | B2 | | 3/2007 | Bennett et al. | |
| 7,320,201 | B2 | * | 1/2008 | Kitchen et al. | 52/426 |
| 7,337,591 | B2 | | 3/2008 | Molina | |
| 7,516,589 | B2 | * | 4/2009 | Messiqua et al. | 52/646 |
| 7,757,448 | B2 | * | 7/2010 | Zhu | 52/309.12 |
| 8,375,669 | B2 | * | 2/2013 | Krayenhoff | 52/429 |
| 2004/0200176 | A1 | | 10/2004 | Olsen | |
| 2004/0226259 | A1 | | 11/2004 | Barnet et al. | |
| 2005/0229536 | A1 | * | 10/2005 | Yoshii et al. | 52/783.11 |

FOREIGN PATENT DOCUMENTS

| | | |
|---|---|---|
| WO | WO 93/22905 | 11/1993 |
| WO | WO 99/22096 | 5/1999 |
| WO | WO 2005/042875 | 5/2005 |
| WO | WO 2005/068748 | 7/2005 |
| WO | WO 2007/131279 | 11/2007 |

* cited by examiner

FIG. 2
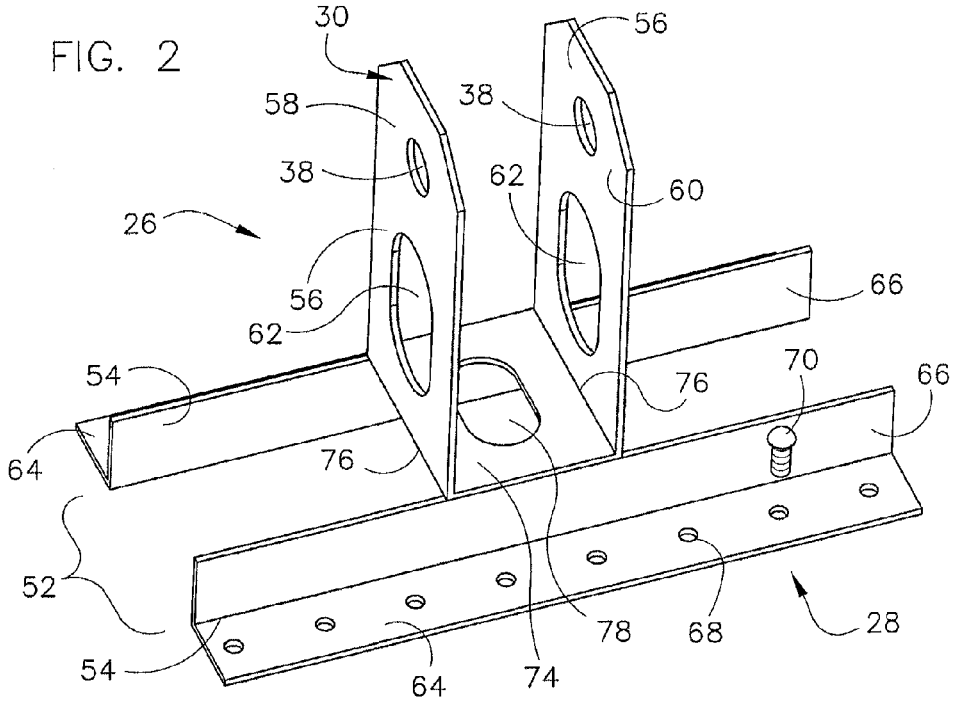
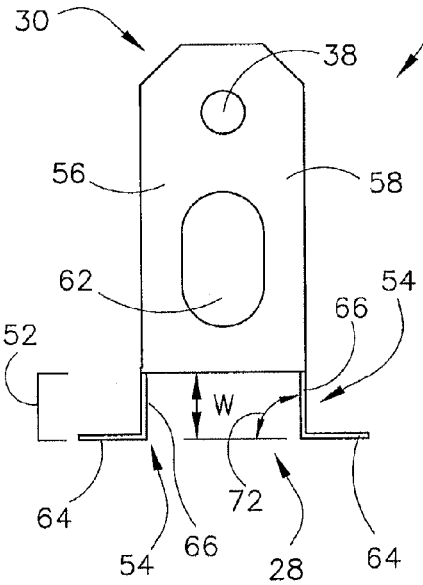
FIG. 3
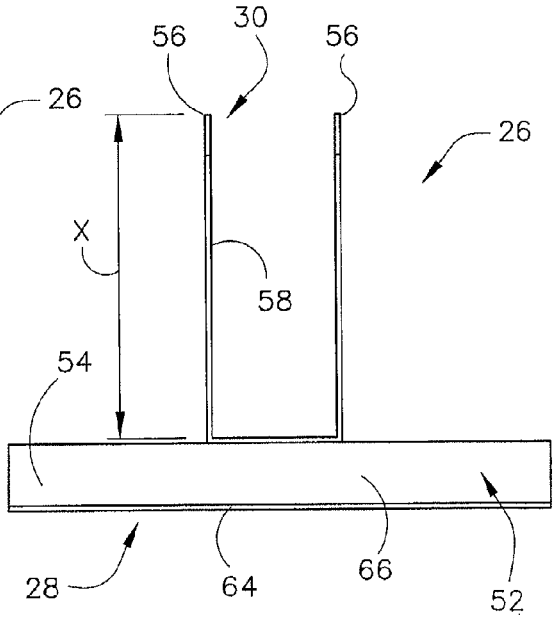
FIG. 4

FIG. 8
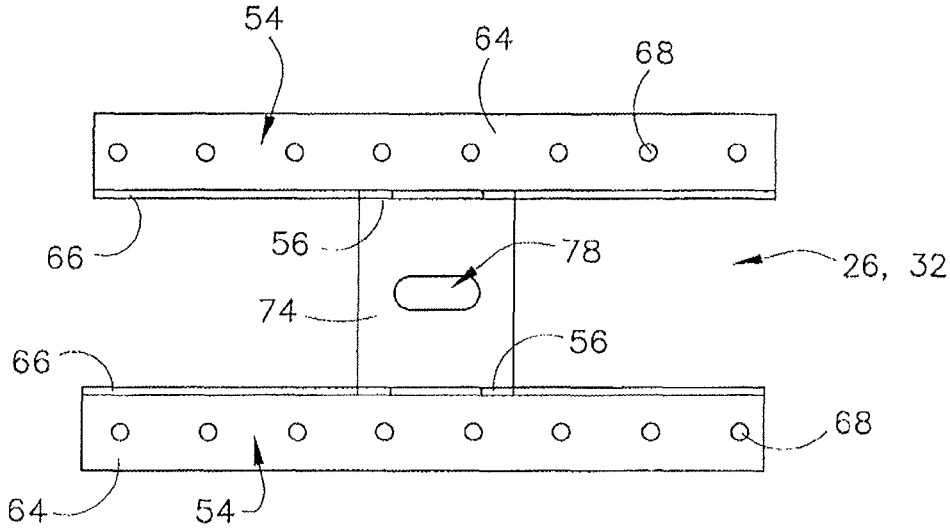
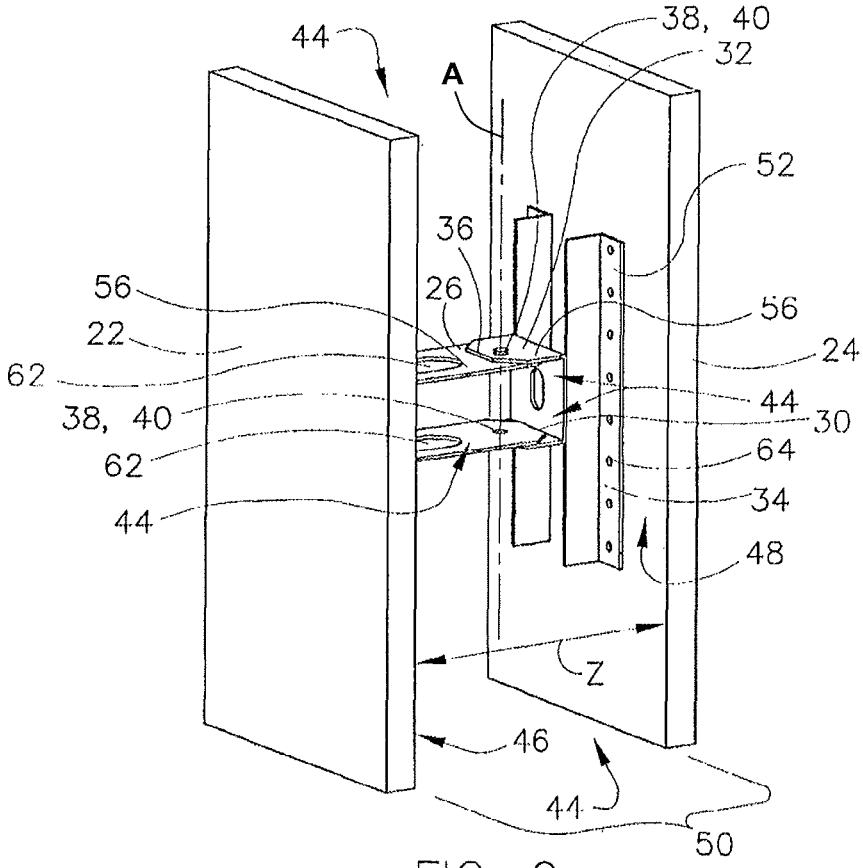
FIG. 9

LOAD BEARING WALL FORMWORK SYSTEM AND METHOD

CROSS REFERENCE TO RELATED APPLICATIONS

This application is a continuation of U.S. application Ser. No. 11/856,528, filed Sep. 17, 2007, which claims the benefit of priority to U.S. Provisional Application No. 60/826,823, filed on Sep. 20, 2006, entitled "Load Bearing Wall Formwork System and Method" by Ronald Jean Degen, Fausto Bejarano Castillo, Pablo Rodriguez Acosta and Humberto Trimino Vasquez, the contents of which are incorporated in by reference.

FIELD OF INVENTION

This invention relates to concrete forming structures and bearing walls, ceilings and floors.

BACKGROUND

Concrete and wall forming systems are known. Such systems typically include form members secured in place a distance apart, between which concrete or cement is placed. For instance, in a concrete forming system, a first form member is secured in position and a second form member is secured in position a distance from the first form member. As a result, a space exists between the form members. Within this space, concrete or cement is placed in a partially fluid form. Once the concrete sets, the forms are removed, revealing a wall, floor, or ceiling. In some instances, forms may be connected by a bridge or structural member spanning between the forms to hold the forms in place. Likewise, in some systems, the forms are retained in place and insulating material is provided between the forms. In building construction, it is common to include a web or mesh of reinforcing material such as rebar between the form members prior to adding the concrete, which is then engulfed by the concrete to provide strength to the hardened concrete structure along the weak axis of the solidified concrete.

The foregoing systems, however, suffer drawbacks. These structures often comprise numerous components, components that must be used and discarded, and components which are difficult to assemble, making assembly of the complete structure both time consuming and costly. Moreover, concrete wall forming systems that are connected by a bridge member often-times lack strength to support a significant load or resist stresses thereon.

In view of the foregoing, a need exists for a bearing wall system which is both easy to assemble and has significant structural strength.

SUMMARY OF THE INVENTION

A load bearing wall formwork system and method are disclosed. The load bearing wall formwork system comprises a unique clip and assembly for joining two or more substantially planar structures, such as a wall panels, in a spaced apart manner.

The clip assembly comprises a first clip bracket or member, and a second clip bracket. The first clip member has a first side for attachment to the first planar structure, a second side opposite the first side and a first opening positioned between the first and second sides. A second clip bracket or member, which is engageable with the first clip bracket, is also provided having a first side for attachment to a second planar structure, a second side opposite the first side, and an opening between the first and second sides. The openings provided in the engaging sections of the first and second clip brackets are aligned when the clip brackets are engaged. A rod or connecting element is insertable into the aligned openings of the first and second clip brackets, maintaining the first and second clip brackets in the engaged condition and, therefore, retaining the first and second planar structures in a spaced-apart orientation.

The clip bracket for the panel assembly comprises an attachment member for attachment to a panel, a first engaging arm attached to the attachment member and spaced a distance from the panel, and a second engaging arm attached to attachment member parallel with the first engaging arm and spaced a distance from the panel. The first and second engaging arms include openings therein. These openings are substantially aligned to allow for the insertion of a connecting element or other device.

The method for assembly of a load bearing wall including the foregoing components comprises the steps of providing a first wall panel and a second wall panel, attaching a first clip member or bracket having an engagement member and an opening in the engagement member to the first wall panel, and attaching a second clip member or bracket having an engagement member and an opening in the engagement member to the second wall panel. In a preferred embodiment, a plurality, or more preferably a defined number, of first clip brackets and second clip brackets are attached to first and second wall panels. After attaching the clip brackets to the walls, reinforcing elements may be attached to one or more of the wall panel(s). The second wall panel is positioned in an opposed relation to the first wall panel, so that the first and second clip members face each other. The first and second wall panels with attached clip members are then moved into engagement, engaging the first and second clip members at their engagement members. Subsequently, the openings in the engagement member of the first and second clip members are aligned. A connecting member, such as a rod, is inserted into the aligned openings of the clip brackets. When a plurality of clip brackets assemblies are used, a plurality of connecting members are inserted into the aligned openings of the clip bracket rows and/or columns. In a preferred embodiment, the assembled bearing walls may be transported to the building site, placed in their corresponding position on the foundation or floor slabs and attached to each other to conform the designed structural walls. Finally, a flowable material, such as concrete, is placed into the space defined between the first and second wall panels and allowed to harden, forming the wall.

Other aspects, features and details of the present invention can be more completely understood by reference to the following detailed description in conjunction with the drawings, and from the appended claims.

BRIEF DESCRIPTION OF THE DRAWINGS

FIG. 2 is a perspective view of a first clip bracket as used in the assembly shown in FIG. 1.

FIG. 3 is an end elevational view of the clip bracket shown in FIG. 2.

FIG. 4 is a side elevational view of the clip bracket shown in FIG. 2.

FIG. 8 is a top plan view of the clip bracket of FIGS. 2 and 5.

FIG. 9 is a perspective view of the assembly absent a connecting member.

DETAILED DESCRIPTION OF PREFERRED EMBODIMENTS

As can be seen from the Figures, a clip assembly 20 for joining two or more substantially planar structures or wall panels is provided. While "wall" is used for purposes of discuss herein, the system and assembly may be applied to walls, floors, ceilings, or other supporting structures. Likewise, while "panel" and "planar structure" are used herein, any board or like structure may be substituted in place of same.

Figure 1:
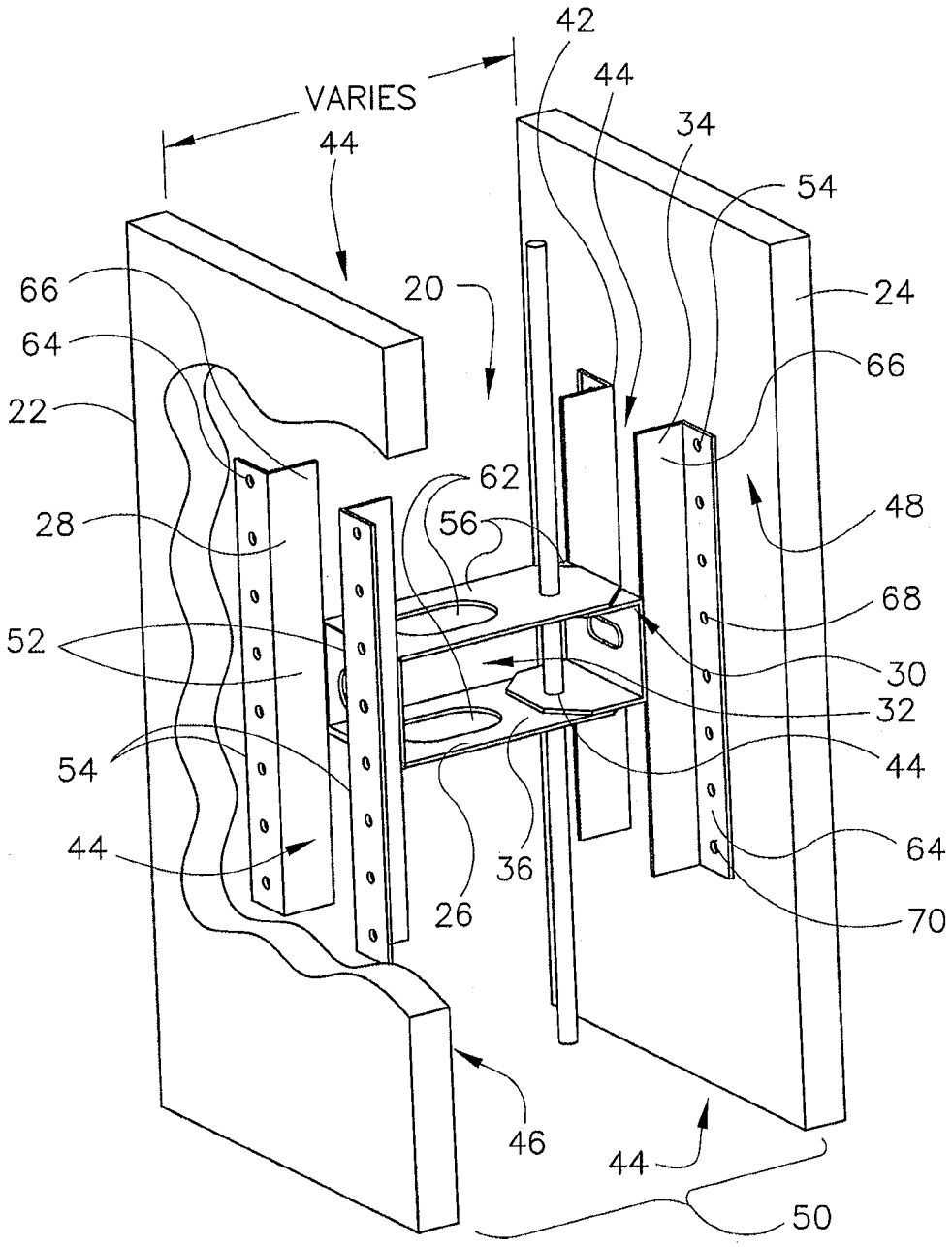
FIG. 1 is a perspective view of the first and second clip brackets attached to a bearing wall assembly and engaged and aligned to each other with the connecting rod positioned according to the preferred embodiment.

Specifically, a clip assembly 20 for joining two or more panels 22, 24 in a spaced apart manner is disclosed. As can be seen in FIG. 1, the clip assembly 20 includes a first clip bracket 26, or member, that has a first side 28 for attaching to a panel 22 or 24 and a second side 30 opposite the first side. A second clip member 28 is also provided. The second clip member 28 or bracket, has a first side 34 for attachment to a second panel 24 and a second side 36 opposite the first side. The second clip member 28 is engageable with the first clip member 26. In a preferred embodiment, the second sides 30, 36 or ends of each clip member 26, 32 overlap in the assembled state. The first clip member 26 and the second clip member 32 further include an opening 38, 40 positioned therein. Preferably, each clip member 26, 32 includes at least two aligned openings 38 or 40. Moreover, the openings 38, 40 in the first and second clip members 26, 32 are aligned along axis A when the clip members are engaged (see FIG. 9). As a result, an opening, or hole, passes through the first clip bracket 26 and the second clip bracket 32. A connecting member 42 or element may be used to attach the first clip member 26 to the second clip member 32. In a preferred embodiment, rod 42 may be inserted along axis A into the aligned openings 38, 40 of the first and second clip brackets 26, 32 to connect or link the brackets. Namely, rod 42 passes through the opening(s) 38 in the first clip bracket 26 and the opening(s) 40 in the second clip bracket 32, securing the brackets together. As will be discussed in further detail herein, the rod 42 may further comprise an end having a retention means, such as a bend in the rod or other attached structure. The bend prevents the rod 42 from sliding from its position in the clip bracket.

The wall panels 22, 24 or planar structures, discussed herein may comprise fiber board, wall board, composites, concrete, cement, masonite, fiber cement, wood, plastic, polyurethane, and/or combinations thereof. For example, a wall panel comprising an organic fiber cement asbestos-free board having no crystalline silica added, which is based upon a mixture of cellulose fibers, cement and calcium carbonate, with or without ARGF and with or without impregnator coating may be used for the assembly described herein. Moreover, the planar structures or wall panels may be of any size and thickness preferred by the manufacturer or the user. The clip brackets may comprise a metal material, such as steel, aluminum, and/or other metals of sufficient rigidity to retain the wall panels 22, 24 a distance apart and support a load of a desired weight. However, plastics and other composites and/or materials meeting the desired characteristics may also be used for the clip members herein, or portions thereof. The clip brackets may be of any size and thickness preferred by the manufacturer or the user. The connecting member 42 preferably comprises a steel rod, such as a rebar rod, or like structural rod for use in construction, but other metals, plastics, and/or composites may be used. The rod may be of any size and thickness preferred by the manufacturer or the user.

Referring to FIG. 1, a bearing wall assembly 100 is shown. Specifically, a clip assembly 20 is attached to a portion of each of a first 22 and a second 24 wall panel. As can be seen, the clip assembly 20, generally, fastens a first substantially planar structure 22 to a second substantially planar structure 24 in a spaced apart manner and includes a number of open spaces 44 for the passage of a flowable material, or structural elements. For ease of reference, only a single clip assembly 20 is shown in FIG. 1, but more than one clip assembly or clip bracket may be provided on the wall structure 22 or 24.

The first clip bracket 26 is attached to a surface or face 46 of the first wall panel 22 and extends outwardly therefrom. A second clip bracket 32 is attached to a surface or face 48 of the second wall panel 24 and extends outwardly therefrom. Preferably, the first and second clip members 26, 32 are provided in an opposing orientation, so that when assembled, the second ends 30, 36 of each clip bracket are in contact or at least partially overlap. The first clip bracket 26 and the second clip bracket 32 are further attached or secured together by connecting member 42, such as the insertion of a rod 42 through aligned openings 38, 40 in the first and second clip members. However, other means of attaching the first and second clip members 26, 32 may be acceptable for the purposes provided, such as by fasteners, tongue and groove assembly, integral clips, adhesive and other attachment mechanisms. When fully assembled, the combined assembly 20 includes one or more openings 44 adjacent the wall panel 22 or 24 as well as within the assembled clip bracket(s) 26, 32. As indicated, these openings 44 provide additional areas for insertion of structural members, such as rods, bars or other supports. In addition, these openings 44 provide areas in which flowable material, such as a cement, concrete or other building material, can flow through the structure, thereby substantially filling the space 50 between the wall panels 22, 24.

In a preferred embodiment, the base clip assembly 20 comprises two clip brackets 26, 32 or members. Referring to FIGS. 2-11, each clip bracket 26 or 32 includes an attachment member 52 for attachment to a wall panel 22 or 24 and an engaging or engagement member 56. The engaging member 56 has first 58, 58' and second 60, 60' engaging arms that are attached to the attachment member 52 of each bracket 26, 32. The engaging arms 58, 60, 58', 60' are preferably planar and positioned horizontally in the assembly 20 for a vertical wall structure. In this arrangement a rod 42 can be easily inserted vertically during assembly. The second engaging arm 60, 60' is parallel with the first engaging arm 58, 58' forming a C-shaped clip bracket. An opening 38 or 40 is provided in the first engaging arm 58, 58' and an opening 38 or 40 is provided in the second engaging arm 60, 60'. These openings 38 or 40 are substantially aligned. As a result of this alignment, a rod 42 or bar may be inserted through the openings. An additional opening 62 may be provided in each of the engaging arms 58, 60, 58', 60' to permit the flow of material or insertion of additional structures as described above. In a preferred embodiment, as can best be seen in FIGS. 3 and 6, the attachment member 52 spaces the engagement member 56 a distance away from the face 46, 48 of the panel 26, 32.

In the preferred embodiment, the attachment member 52 comprises a pair of longitudinal members 54 for attaching to the wall panel 22, 24. As can be seen from FIGS. 1-8, preferably, the longitudinal members 54 have a first arm 64 for attachment directly to the panel 22 or 24. The first arm 64 is in contact with the panel 26 or 32 and may include one or more openings 68 there through for the insertion of a fastening device 70, such as a screw, a nail, a rivet, a bolt or comparable device. Alternatively, the first arm 64 may be welded or molded integral with the panel or may be attached by adhesive. Preferably, a plurality of openings 68 are provided in the first arm 64, through which a threaded member 70, such as a screw, is inserted to secure the arm 64 on a first face 46 or 48 of the panel 26 or 32. The longitudinal member 54 also includes a second, raised arm 66 which connects the first arm 64 to the engaging member 56. Preferably, the second arm 66 is raised a distance W, or extends at an angle 72 away from the face 46, 48 of the panel so that the engaging member 56 is raised a distance from the attachment to the panel 26, 32. The second arm 66 is approximately positioned at an angle 72 of 90° from the first arm 64 and the face 46, 48, but such an angle is not necessary, as other positions of the arm 66 and angles 72 would be acceptable for the purposes described herein.

Figure 5:
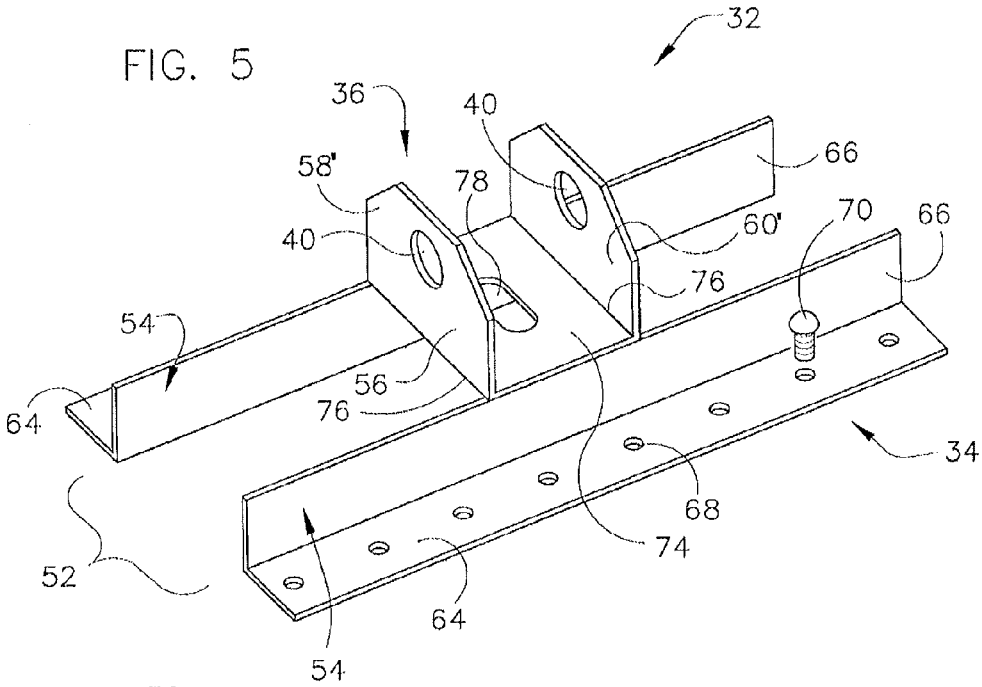
FIG. 5 is a perspective view of a second clip bracket as shown in FIG. 1.
Figure 6:
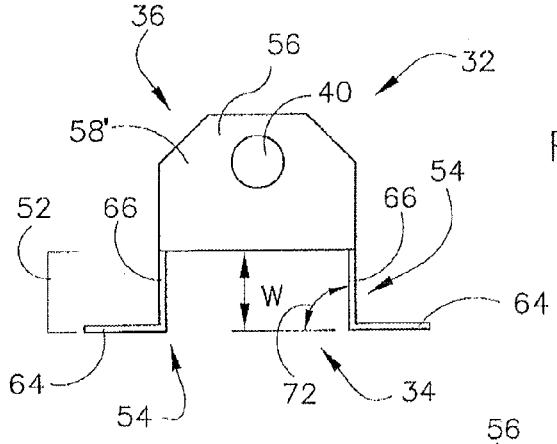
FIG. 6 is an end elevational view of the clip bracket of FIG. 5.
Figure 7:
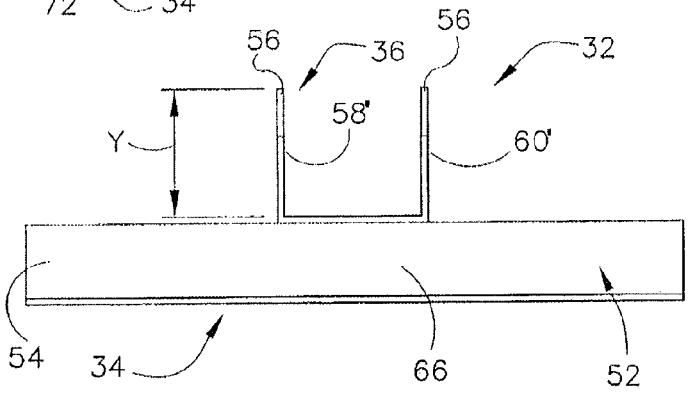
FIG. 7 is a side elevational view of the clip bracket of FIG. 5.

As can be seen in FIGS. 2 and 5, a second parallel longitudinal member 54 is provided, and is a mirror image of the first longitudinal member. In the preferred embodiment, the second longitudinal member 54 is spaced a distance from the first longitudinal member 54. With the exception of orientation, as can be seen in FIGS. 1 and 8, the structures are substantially identical. Therefore, the second longitudinal member 54 will not be described in further detail herein.

Referring to FIGS. 2, 5 and 8, connected to the attachment member 52, and extending between the first and second longitudinal members 54, and between the first and second engaging arms 58, 60, 58', 60', is a base member 74. The base member 74 is attached, or in contact with, the lower portion, and preferably the lower edge 76 of the first and second engaging arms 58, 60, 58', 60'. The base member 74 extends the width of the first and second engaging arms 58, 60, 58', 60' and spans the distance from the first longitudinal member 54 to the second longitudinal member 54. The base member 74 is, thus, both in contact with, or attached to, the attachment member 52 at the second raised arm(s) 66, and engagement member 56 at the first and second engagement arms 58, 60, 58', 60'. In a preferred embodiment, the base member 74 is attached by welding to each of the aforementioned components. Alternatively, a clip bracket may be formed by die or mold cutting as a single unit that is later bent into the shape and arrangement desired. Other means of attachment would be acceptable for purposes provided herein, including, but not limited to, adhesive or fasteners. The base member 74 preferably has an opening 78 therein to permit flow of material or insertion of components, such as support rods, bars or other structure.

Accordingly, the clip bracket 26 or 32 attached as described above is in contact with the wall panel 22 or 24 and has a portion separated a distance from the wall panel to provide additional space or openings to the assembly.

Referring to FIGS. 2-7, in a preferred embodiment, the clip assembly 20 comprises two clip brackets 26, 32 having different dimensions. However, brackets equivalent in size would not depart from the overall scope of the invention. Preferably, a first clip bracket 26 (FIGS. 2-4) has engaging arms 58, 60, 58', 60' that extend a first distance X. The engagement arms of the second clip bracket 32 (FIGS. 5-7) extend a second distance Y. Distance X is greater than distance Y in a preferred embodiment. As a result, when assembled the first clip bracket 26 extends across a greater portion of the distance Z (see FIG. 9) between first wall panel 22 and second wall panel 24. Moreover, the aligned openings 38, 40 of the first and second clip brackets are positioned in close proximity to the second wall panel 24, thereby allowing the insertion of a rod 42 in close proximity to the second wall panel 24. One of skill in the art would understand that variations in dimension of the first and second clip brackets 26, 32 may vary the positioning of the aligned openings 38, 30 between the first wall panel 22 and second wall panel 24. For instance, where the first bracket 26 and second bracket 32 are symmetrical, and of equivalent dimensions, the rod 42 may be centered or positioned at a midpoint between the first wall panel 22 and the second wall panel 24.

Figure 10:
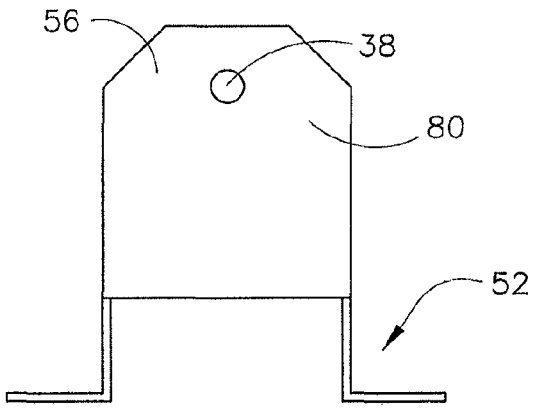
FIG. 10 is an end elevational view of an alternative embodiment of the clip bracket.
Figure 11:
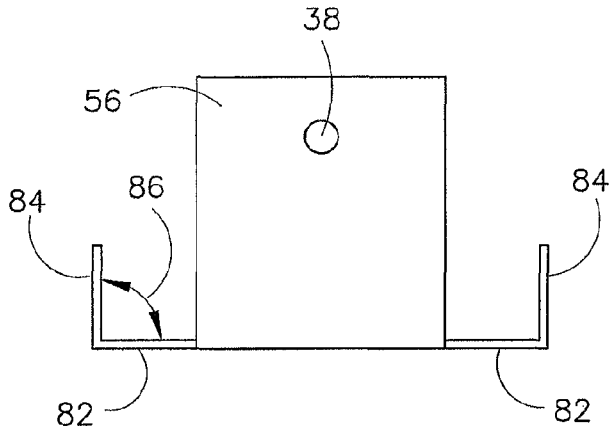
FIG. 11 is an end elevational view of an alternative embodiment of the clip bracket.
Figure 12:
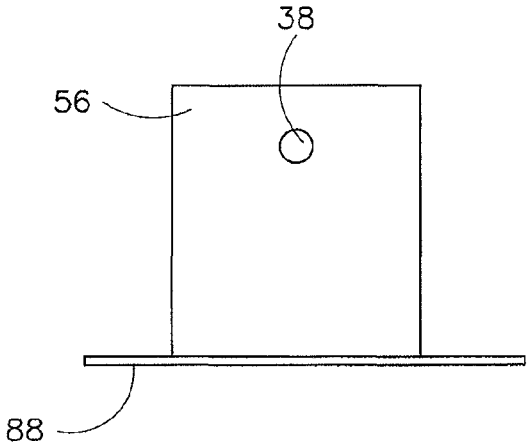
FIG. 12 is an end elevational view of an alternative embodiment of the clip bracket.
Figure 13:
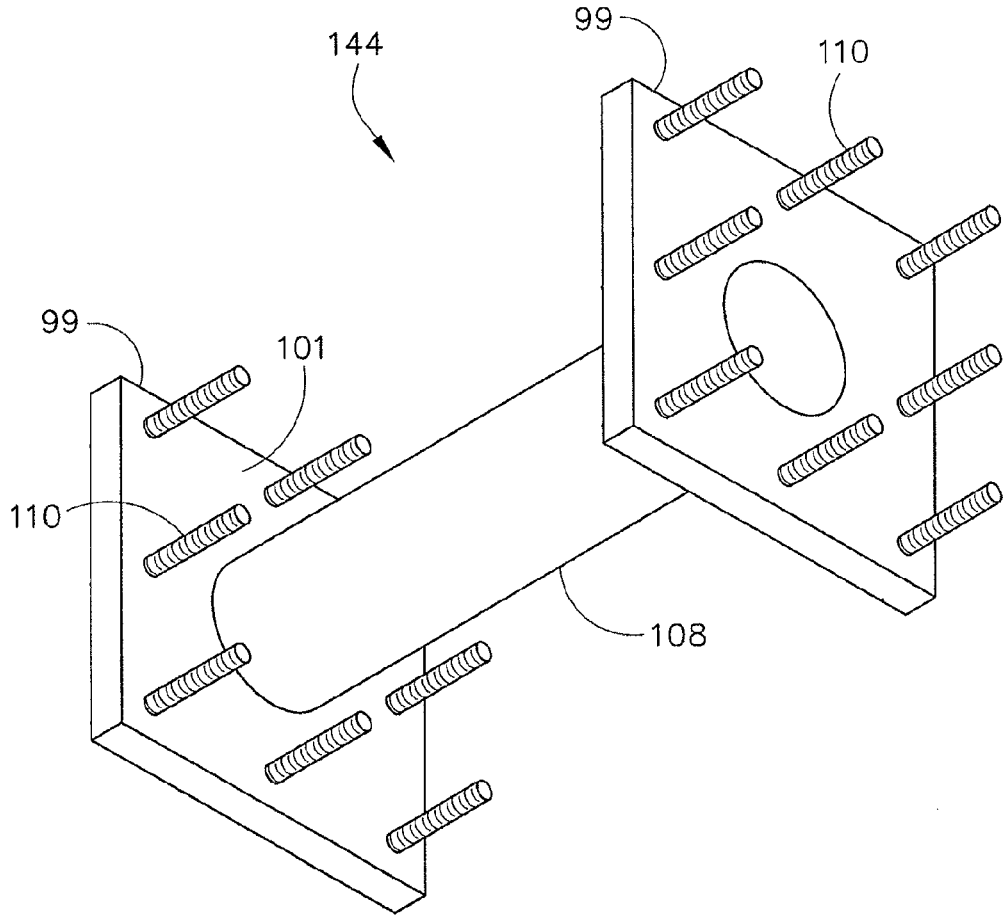
FIG. 13 is a perspective view of a hoisting bar assembly according to one embodiment.
Figure 14:
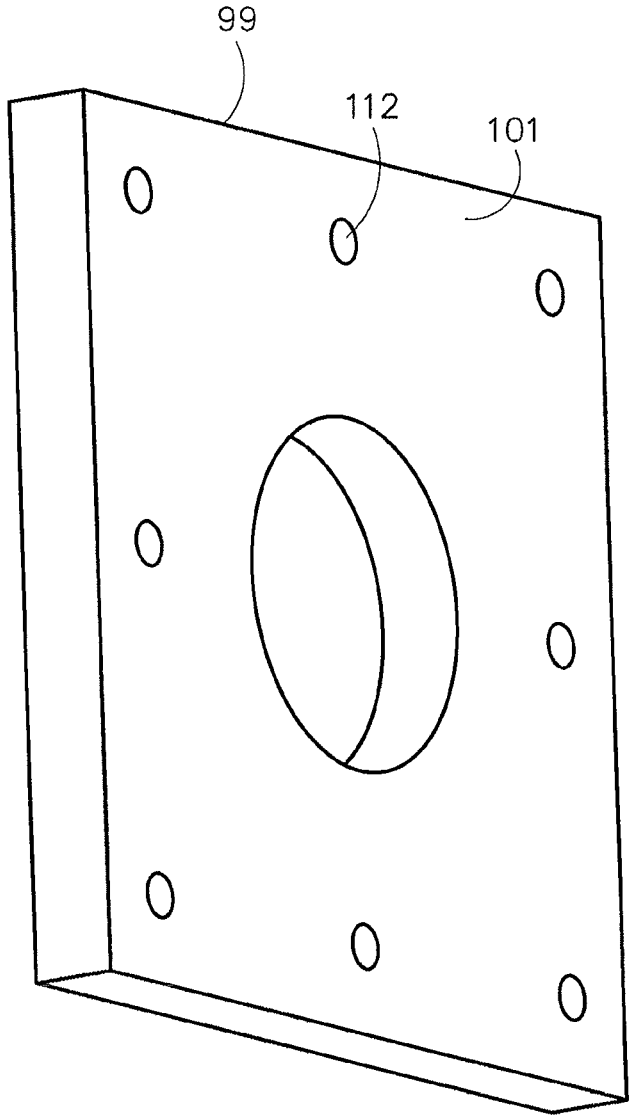
FIG. 14 is a perspective view of a hoisting bar plate shown in FIG. 13.
Figure 15:
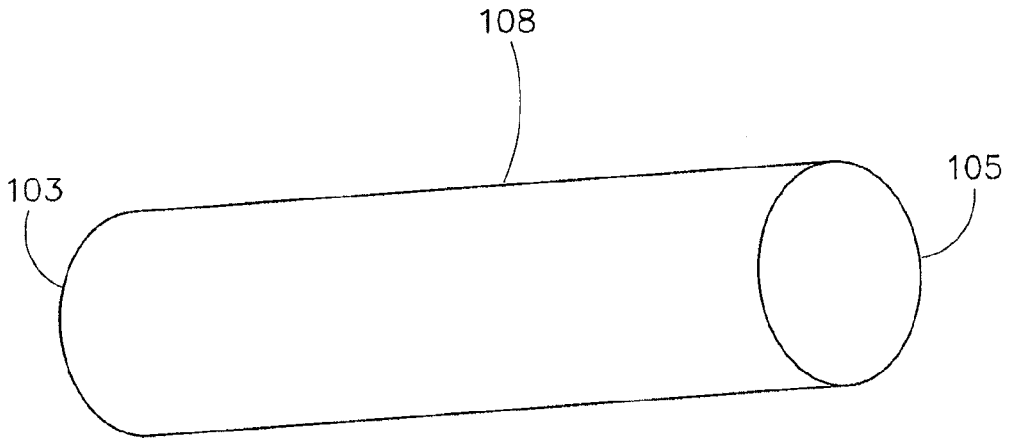
FIG. 15 is a perspective view of a hoisting bar shown in FIG. 13.
Figure 16:
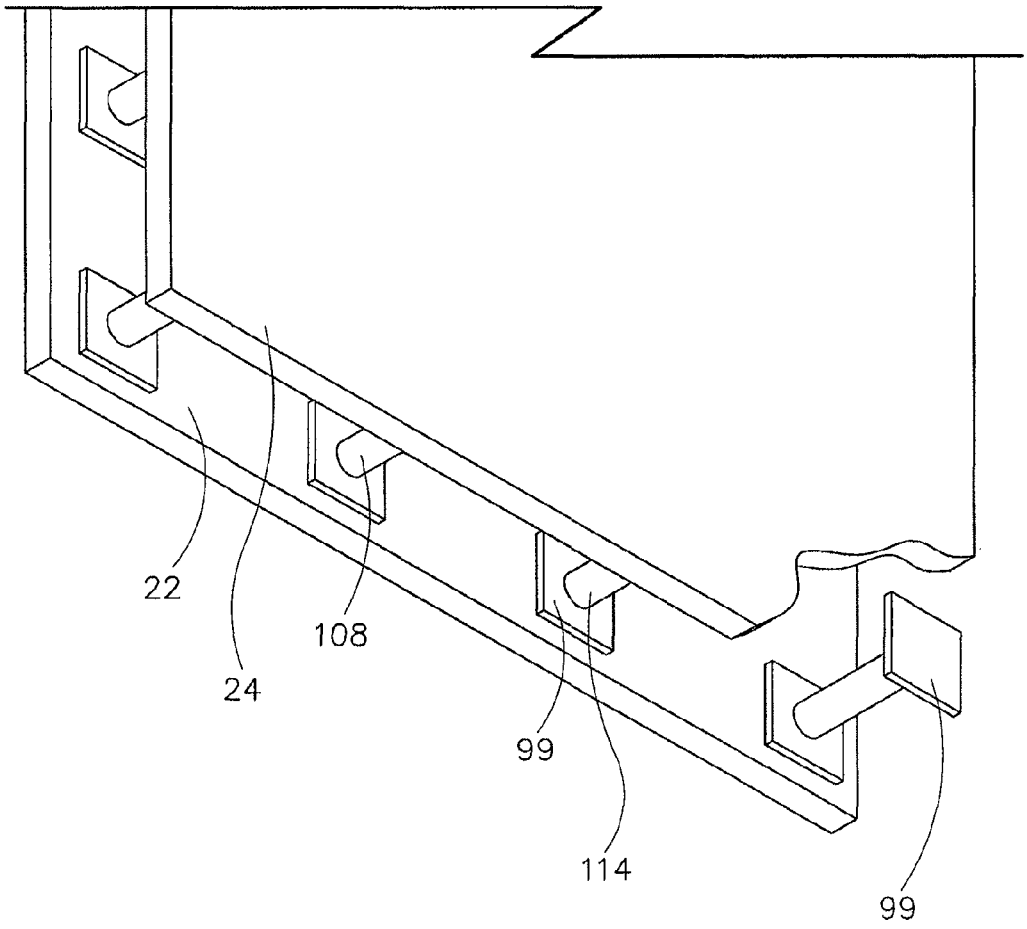
FIG. 16 is a perspective view of a hoisting bar assembly attached to first and second wall panels.

As is shown in FIGS. 10-12, alternative embodiments of the clip bracket may include variations in dimensions, shapes and openings of the engagement members, as well as the attachment members. FIG. 10 shows an engaging member 56 of FIG. 3, absent an additional opening 62. Alternatively, an attachment member 80 may be provided that eliminates the opening or distance between the base member 74 and the attached planar structure or wall panel (see FIGS. 11 and 12). FIG. 11 shows a clip bracket having attachment arms 82 in the same plane as the base member 74 of the clip bracket, while having second raised arms 84 extending at an angle 86 from the outside edge of the attachment arm 82. FIG. 12 illustrates a clip bracket having only attachment arm(s) 88. The arms, shapes, and number of openings illustrated in the Figures are for purposes of example only and one of skill in the art would understand that various dimensions and shapes would be acceptable for purposes of the present clip and assembly.

Figure 17:
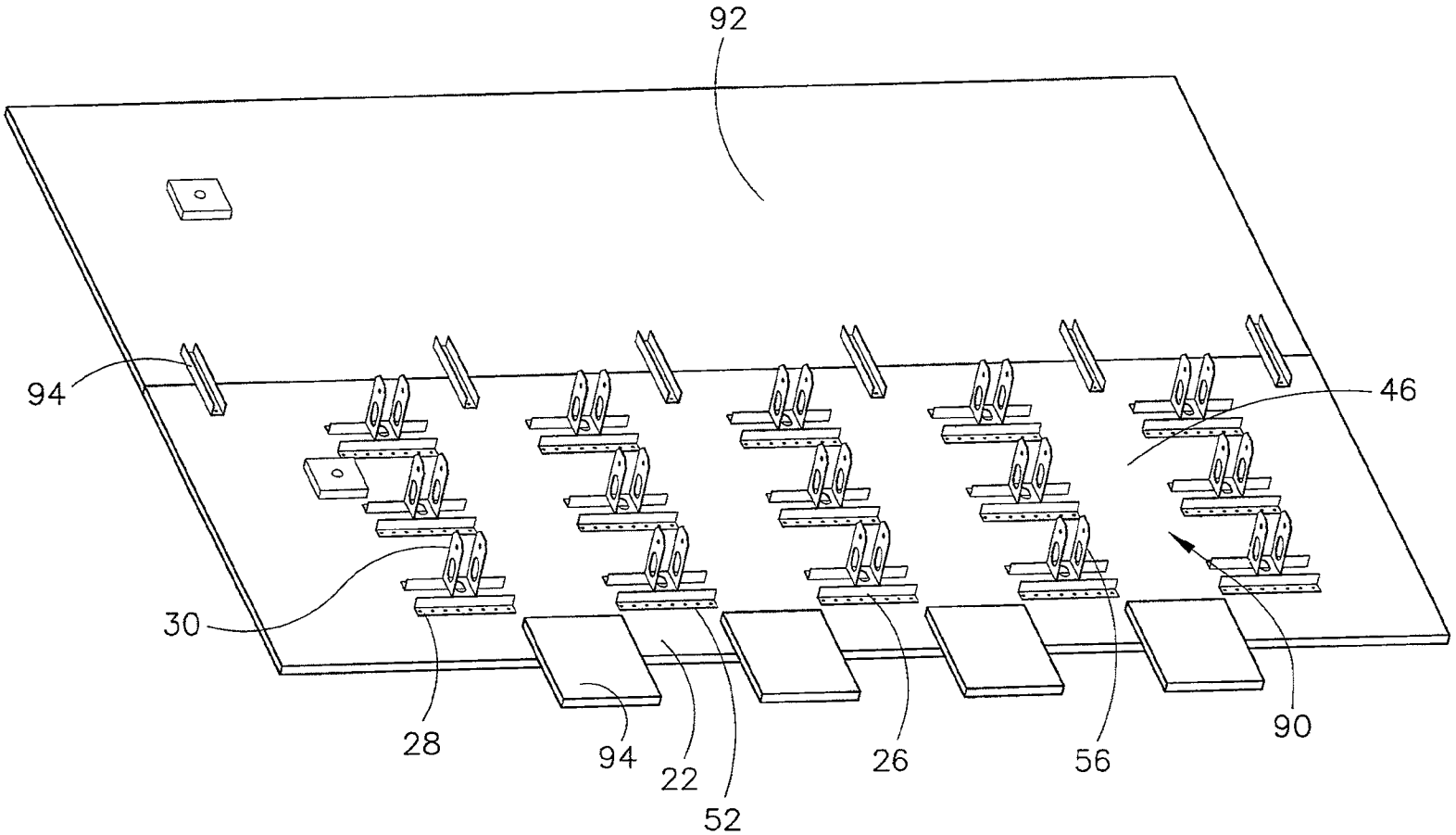
FIG. 17 is a perspective view of a wall panel assembly having clip brackets thereon.
Figure 18:
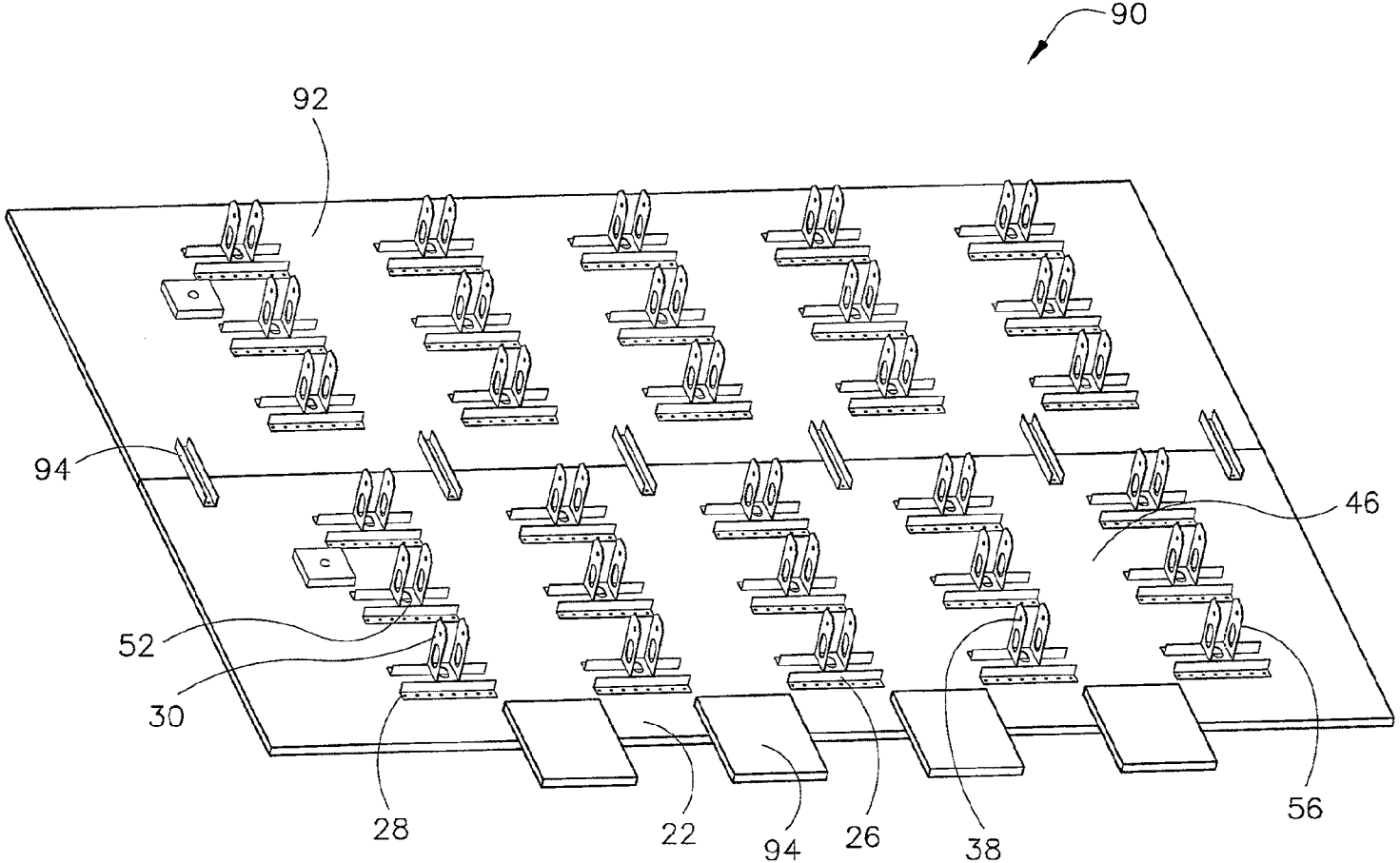
FIG. 18 is a perspective view of adjacent wall panels in an assembly having clip brackets thereon.

FIG. 17 shows an assembly 90 having a plurality of clip brackets 26 or 32 fastened to the wall panel 22 or 24. Preferably, the clip brackets 26 are spaced apart in an equal relation, but any spacing would be acceptable for the purposes provided. Additional wall structures or panels 92 may be attached. The additional panels 92 may optionally contain additional clip brackets 26 or 32 attached thereto. (See FIG.

Figure 19:
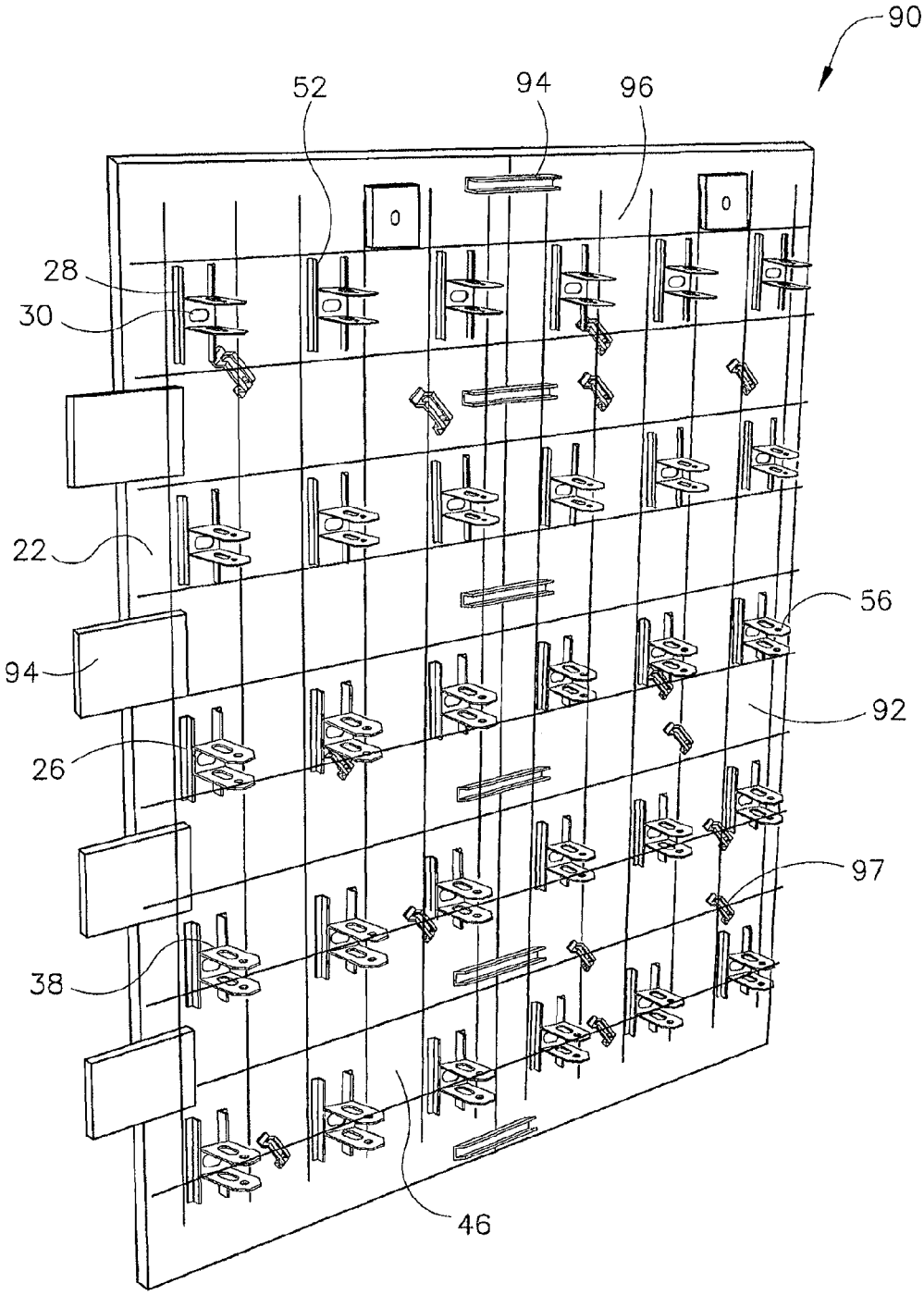
FIG. 19 is a perspective view of a wall panel assembly of FIG. 18, having structural steel reinforcements positioned thereon.
Figure 20:
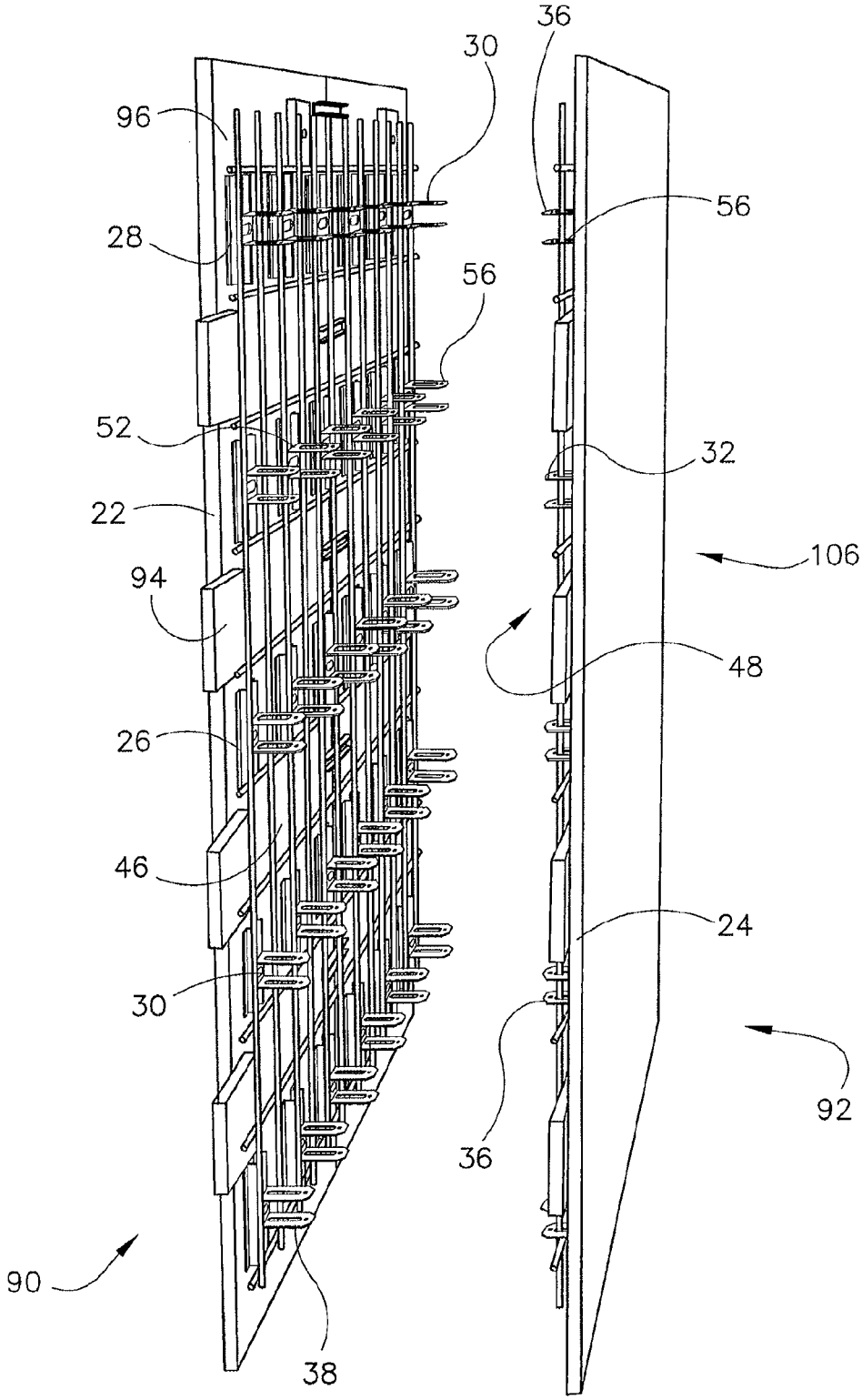
FIG. 20 is a perspective view showing wall panel assemblies in an opposed relation for assembly.

14). Various means of connecting 94 adjacent wall structures are known in the art, any of which would be acceptable for the purposes provided herein. In addition, in the preferred embodiment, the joint between walls consists in a tongue and groove arrangement. As can be seen in FIG. 19, as is common in the assembly of concrete structures, a web or mesh 96 of support rods, such as rebar, may also be provided, which in the fully assembled structure, is surrounded by concrete and provides additional structural strength to the assembly. This web 96 of structural support rods may be attached by fastening clamps 97 or other means commonly known in the art.

Referring to FIGS. 13-16, preferably, the wall panel 22, or assembled wall structures 90 may further contain one or more hoisting bar receiving plates 99. The hoisting bar receiving plate 99 comprises a metal plate with a central protruding metal cylinder 101. While metal is specifically disclosed, other materials are contemplated for the purposes provided herein. The facing wall panel 24 or assembly of wall panels 98 may also have one or more hoisting bar receiving plates 99 attached thereto with identical form and dimensions, and positioned facing the corresponding plate 99 in the first wall panel 22. The central metal cylinders 101 receive the first end 103 and second end 105 of a hoisting bar 108. The hoisting bar 108 may comprise metal or other rigid material of sufficient strength to support the weight of an assembled wall. In a preferred embodiment, the hoisting bar receiving plates 99 are attached to the wall panel 22, 24 by means of fasteners 110 extending through openings 112 in the plate 99, such as threaded screws. However, alternative means of attachment are also contemplated herein, including but not limited to, nut and bolt, adhesive, tongue and groove, integral molding, and the like. The combination of hoisting bar receiving plates 99 and hoisting bar 108 forms a hoisting bar assembly 114, which when fastened to the wall panel assembly, may be engaged by a tool (not shown) to lift and move the assembled structure.

Referring to FIGS. 17 through 24, wall panels 22, 24 having a plurality of clip brackets 26 or 32 positioned thereon are provided. The first wall panel 22 has a first clip bracket 26, or a plurality of same. As discussed above, the first wall panel 22 may also comprise one, two or more hoisting bar receiving plates 99. In a preferred embodiment, two hoisting bar receiving plates 99 are provided on the first wall panel 22. Second wall panel 24 is provided with a second clip bracket 32, or a plurality of same. Similar to the first wall panel 22, one, two or more, and preferably two hoisting bar receiving plates 99 are provided, attached thereto. First wall panel 22 and second wall panel 24 are arranged in an opposing relation so that the first clip bracket(s) 26 and, if included, the hoisting bar receiving plates 99 of the first wall panel assembly 90 face the second clip bracket(s) 32 and, if included, the hoisting bar receiving plates 99 of the second wall panel assembly 98 (see also FIG. 16). If needed, hoisting bars 108 may be placed into the cylinder 101 of each of the hoisting bar receiving plates 99 of the first and/or the second wall assembly 90, 98. The first clip bracket(s) 26 and the second clip bracket(s) 32 are moved together as assemblies 90 and 98 are moved toward each other. Also, during this step, the hoisting bar(s) 108, when placed on assembly 90 will move toward the cylinder(s) 101 of the hoisting bar receiving plate(s) 99 of the facing wall assembly 98. This results in engaging, and preferably slidably engaging, the engagement members 56 of the respective first and second clip brackets 26, 32 and also, when applicable, the engaging of the hoisting bar assemblies 114. The openings 38, 40 in the first and second clip brackets are aligned throughout the combined assembly 20, 100 and a rod 42 is inserted through the openings 38, 40, thereby connecting the first wall panel assembly 90 to the second wall panel assembly 98 and forming an area 102 between the wall panels 22, 24 that can be filled with a flowable material. Moreover, as indicated above, the size of the clip members 26, 32 may vary. Thus, the width of the space 50, 102 between the wall panels 22, 24, and therefore the size or thickness of the wall, may be varied to greater or lesser dimensions.

Figure 21:
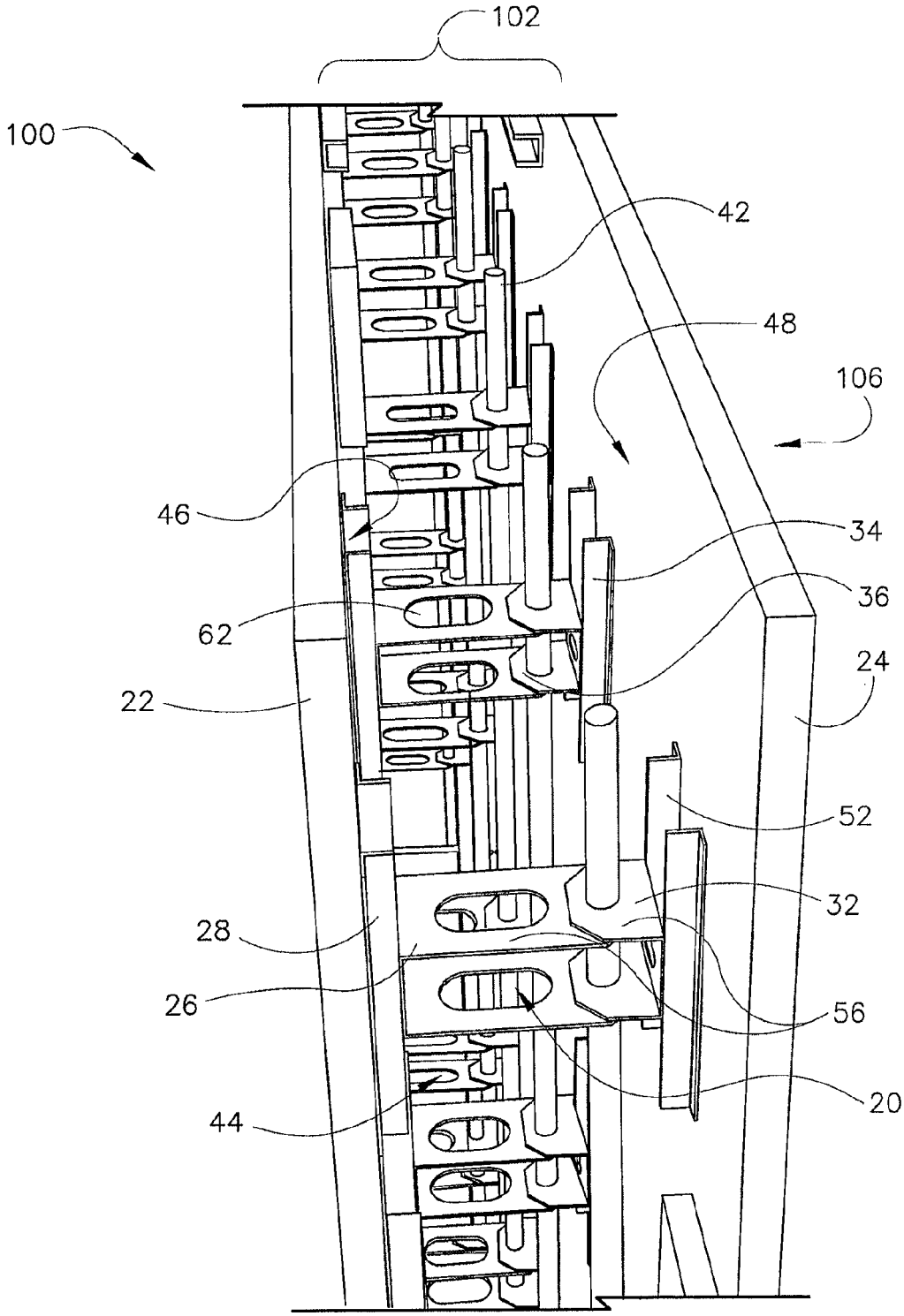
FIG. 21 is a cut away perspective view of the assembly of a preferred embodiment.

In the fully assembled wall structure, as shown in FIG. 21, a plurality of clip brackets 26, 32 and clip assemblies 20 are provided between a pair of wall panels 22, 24 or a plurality of wall panels. This structure may also include hoisting bar assemblies 114. These fully assembled wall structures may be transported to a building site for final positioning and assembly of the walls.

Figure 22:
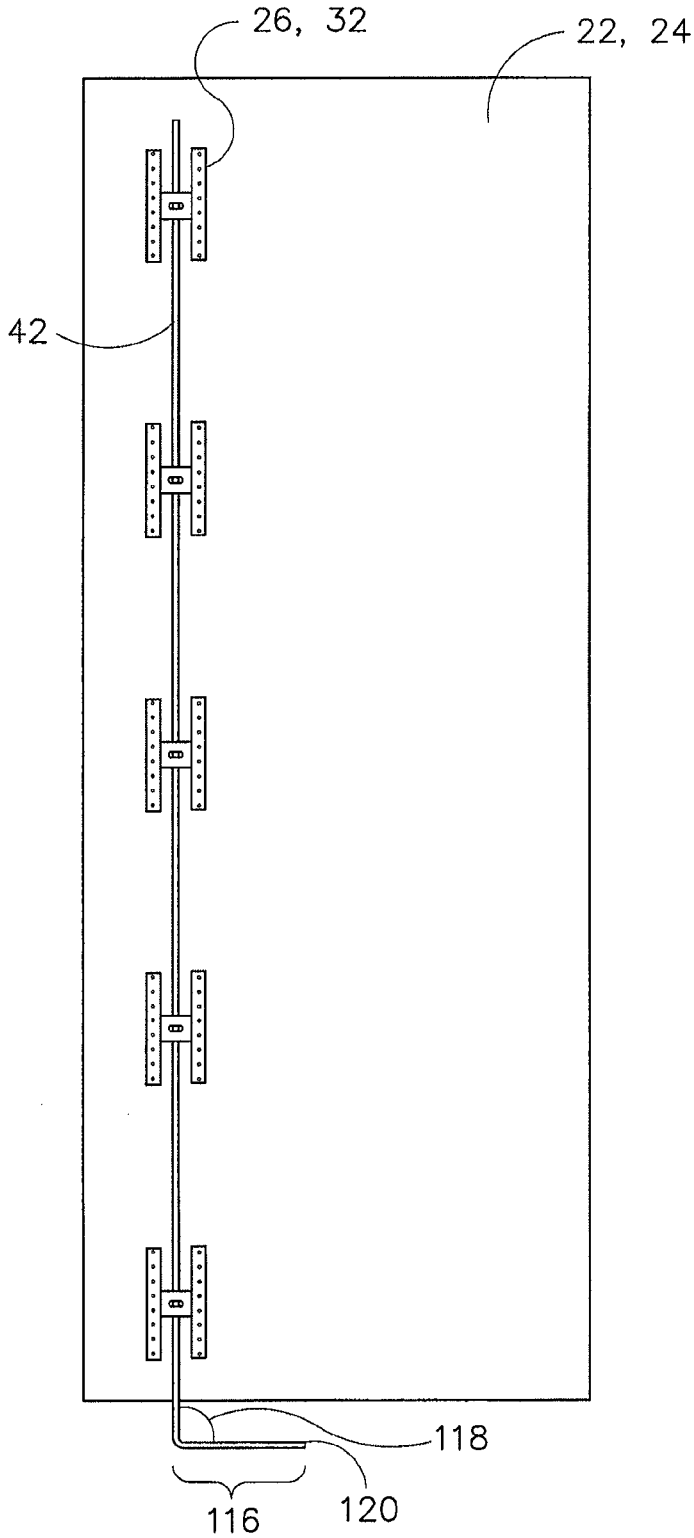
FIG. 22 in an elevated perspective view of a single wall panel comprising clip members and a connecting element.
Figure 23:
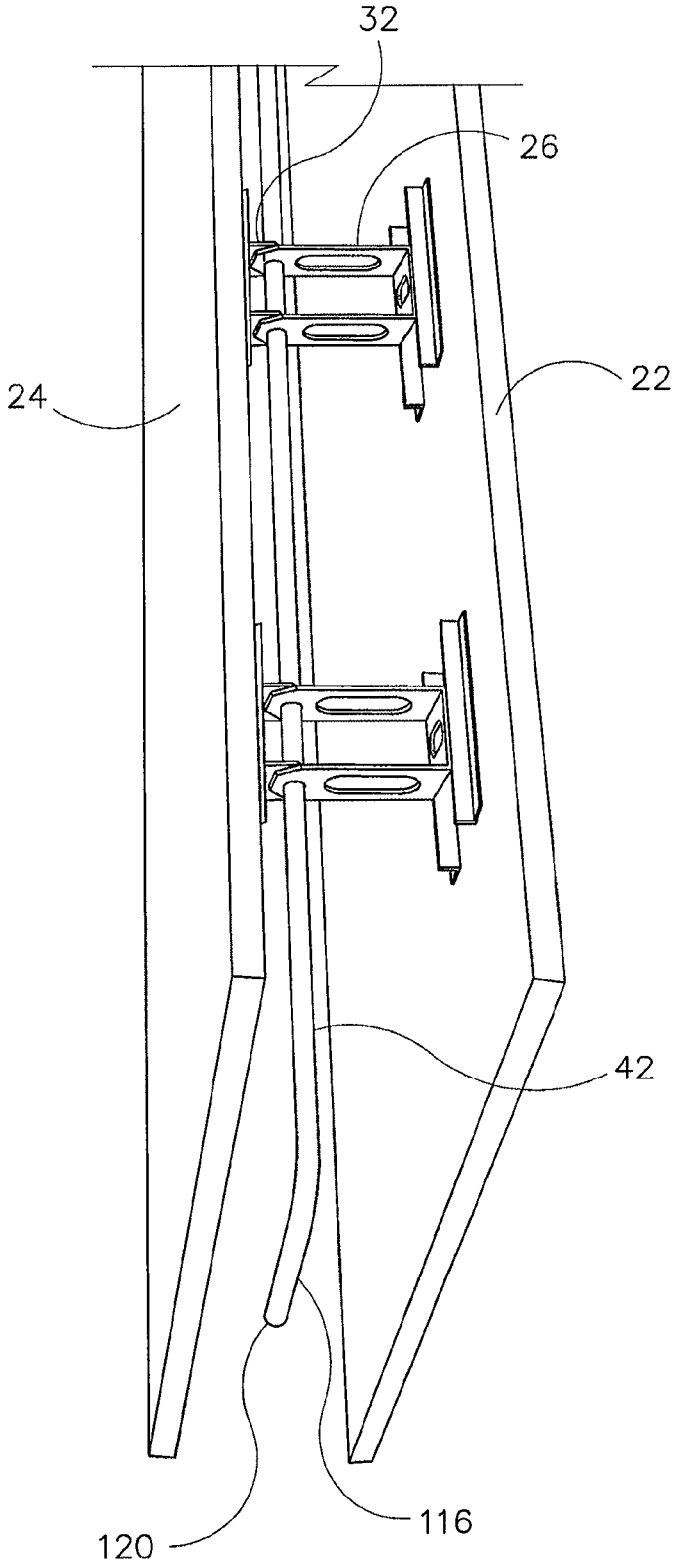
FIG. 23 is a perspective view of an assembly having clip members and a connecting element.

The clip brackets 26, 32 may have connecting members or elements, such as rods 42, inserted therein which results in a plurality of parallel aligned rods 42 in the assembly which add support to the overall assembly 100. Referring specifically to FIGS. 22 and 23, the rods 42 may further comprise an end having a retention means, such as a bend 116 in the rod or other structure attached to the rod 42. While not required, in a preferred embodiment, the rod 42 comprises a 90° angle 118 bend 116 at one end 120. While a 90° angle 118 is specifically disclosed, various angles would be acceptable for the purposes provided herein. The bend 116 prevents the rod 42 from sliding from its position in the clip bracket. In a preferred embodiment, the bend 116 reaches outwardly, allowing for the connection of the rod at the retention means 116 to other structural elements in an assembly, or in a corresponding floor assembly to which the wall assembly is attached. Additionally, in a preferred embodiment, the rod(s) 42 are inserted vertically downward, which assists in the ease of assembly, although other orientations of the rod(s) would not depart from the overall scope of the present invention.

Figure 24:
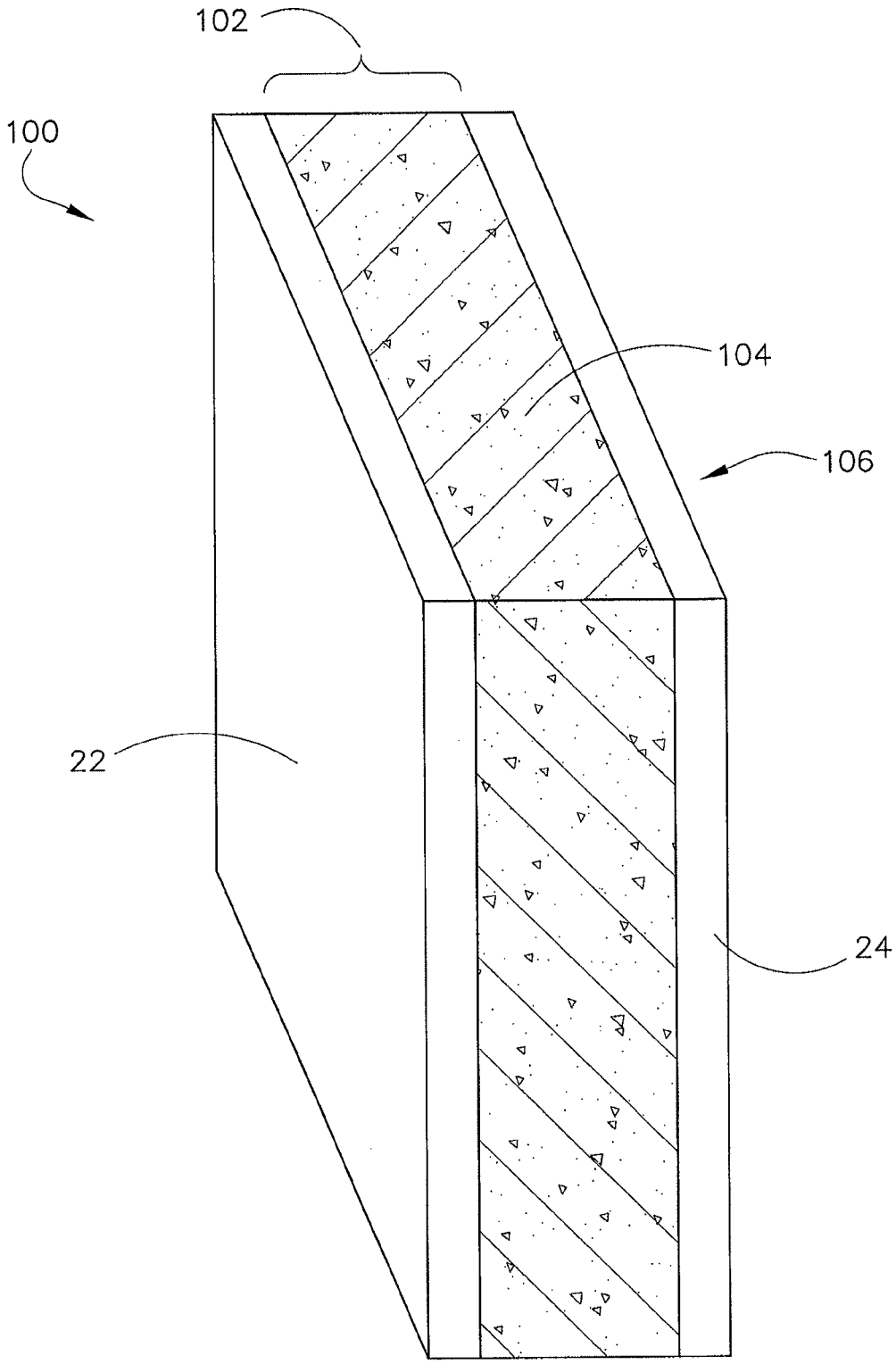
FIG. 24 is a perspective view of a wall assembly of FIG. 21 having flowable material between the wall panels.

As indicated above, a flowable material 104 may be inserted into the space 102 between the wall panels 22, 24 as shown in FIG. 24. The flowable material may comprise concrete, cement, insulation, liquid, gas, or other substance, or any combination thereof. Preferably, the flowable material is a cement or concrete that includes a plasticizer which eliminates the need of vibration to settle the concrete into the load bearing wall assembly. Therefore, the mixture placed within the assembly is fluid during its introduction into the space 102 between the wall panels to allow ease of flow within the openings of the assembled structure 100. The concrete comprises an aggregate size and fluidity suitable for these purposes. The plasticizer may evaporate, leak-out or remain in the hardened concrete. In a preferred embodiment, the system uses a self-compacting concrete having a maximum aggregate diameter of 20 millimeters that requires strict grading control. The concrete admixture is formulated with plasticizers and additives to permit a low water-to-cement ratio, insuring free flow throughout the assembly. Preferably, the concrete has a capacity of flowing and compacting without the aid of vibration, thereby ensuring significant homogeneity of the hardened concrete. For instance, a self-compacting low-viscosity concrete or cement with a water-to-cement ratio of less than 0.55 and a characteristic cube strength of approximately 35 $N/mm^2$ or 350 $kg/cm^2$, a minimum slump of 150 mm and a granulometry having a maximum grain diameter of 22 mm may be acceptable for use. While a specific concrete is described herein, the flowable concrete used herein may comprise a wide variety of known and currently used commercial concretes having the properties needed for the purposes desired by the assembler and/or manufacturer. Likewise, the concrete formulation will vary depending upon local cement or concrete characteristics which may define the types and quantities of air-entrapment and plasticizing additives. Moreover, the granulometry and characteristics of the available aggregate may influence the formation. Local conditions, such as temperature and moisture at the time of pouring may also have influence on the concrete formation. Accordingly, the concrete is prepared to meet the applicable conditions.

Accordingly, a wall assembly is formed having a plurality of wall panels 22, 92 adjacently aligned and attached to a second set of wall panels 24, 106, spaced a distance Z therefrom by the clip assembly 20 described hereinabove. The area 102 between the wall panels 22, 92, 24, 106 is filled with a concrete mixture 104 that cures and hardens to form a complete wall structure as shown in FIG. 24, having panels 22, 24, clip assembly 20, the rebars or connecting rods 42, the structural reinforcements, if required by the design, and concrete 104 in a combined assembly. In this assembly, it is not necessary to remove the wall panels 22, 24 as in other concrete forming systems. Furthermore, the wall panels 22, 24 and assembly itself contribute to the structural strength and rigidity of the wall. As a result of the combined assembly, the wall is able to bear or support a significant load.

The method of assembling the bearing wall system using the foregoing components will now be discussed in further detail in reference to FIGS. 9 and 13-24. Preferably, a first wall panel 22 is attached to a plurality of first clip members 26 or brackets. A second wall panel 24 is, likewise, assembled with a plurality of second clip brackets 32. The brackets may be attached by fasteners 70 inserted through openings 68 in the longitudinal members 54 of the clips, or by other means discussed herein. The clip brackets 26, 32 are positioned on the respective first wall panel 22 and second wall panel 24, so that when assembled, the first clip bracket(s) 26 are opposed and aligned with the second clip bracket(s) 32 (see FIGS. 9 & 20). Opposing faces 46, 48 of the first and second wall panels 22, 24 therefore have attached brackets. Once the brackets are attached to the panels, the panels 22, 24 are brought together to engage the first clip bracket(s) 26 with the second clip bracket(s) 32, resulting in the engagement of the engagement members 56 at the engagement arms 58, 60 (see FIGS. 9 & 21). Turning to FIG. 21, after the clip members 26 and 32 are engaged, the openings 38 and 40 are aligned and a connecting member is used to connect the clip brackets. In a preferred embodiment, rod 42 is inserted through the aligned openings 38, 40, which when a plurality of clip brackets are used, results in the insertion through a plurality of clip brackets. Namely, a plurality of parallel rods 42 may be inserted through adjacent aligned clip brackets and/or a single rod 42 may be inserted through a plurality of openings in a plurality of aligned clip brackets, both of which can be see in FIG. 21.

Using the aforementioned method, an assembly 20 or 100 is formed which has numerous openings 44, 62 in the assembly and between the first wall panel 22 and the second wall panel 24. The openings 44, 62 are capable of receiving a flowable material 104 and/or additional structural elements, including, but not limited to, connector bars placed in the foundation and/or floor slab on which the bearing wall will be placed that will provide structural integrality between the walls and the foundation. Thus, once the assembly 20, 100 is created, cement or concrete 104 is poured into the space 50, 102 between the wall panels 22, 24 and substantially surrounds the clip members 26, 32 and rods 42. The concrete 104 cures and hardens in the space, forming a complete wall structure having two wall panels, attached clip assemblies, and concrete, which structure has significant strength and rigidity. The wall assembly may be further integrated to the foundation and/or floor slab. Moreover, due to the option of varying the size of the clip members 26, 32, the width of the space 50, 102 between the wall panels 22, 24, and therefore the size or thickness of the wall, may be varied to greater or lesser dimensions. Additionally, as shown in FIG. 19, additional structural support members 96 such as rebar, may be added prior to introduction of the flowable substance to further strengthen the wall.

The installation and assembly of a wall with the foregoing components requires minimal time and effort as the assembler must simply attach the clip brackets to the wall panel, align the wall panels, and insert a connecting member into the aligned openings of the clip brackets. Assembled bearing walls may be placed in transporting racks and transported to a building site. They can be hoisted by means of the hoisting bars and placed in their corresponding position on the foundation or floor slab, which may have embedded therein, the connecting rods 42 to integrally connect the walls with the foundation or floor slab. A leveling prop connector for attaching a prop for retaining the formwork wall section leveled on a building site may also be attached to the assembled bearing wall for use in assembly at the construction site. A transportable wall assembly may comprise a plurality of bearing wall panels with clip brackets and structural elements included. In a preferred embodiment these panels are transported to the building site and hoisted into the specific desired position. Subsequently, concrete is introduced into the area between the panels. As result, the assembly and method described herein save significant time, effort and cost in the construction of a load bearing structure.

In the foregoing system and devices, wall panels are assembled by means of a unique anchoring system which may have a variety of dimensions according to the requirements of the site, the manufacturer and or the user, permitting great versatility in the design. The formwork walls formed by the system and method described comprise a high performance and efficient building solution that is capable of safely withstanding strains produced by static and dynamic loads acting on structural walls.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references (e.g., upper, lower, upward, downward, left, right, leftward, rightward, top, bottom, above, below, vertical, horizontal, clockwise, counterclockwise, x-axis, y-axis, and z-axis) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

The following paragraphs enumerated consequently from 1 through 39 provide for various aspects of the present invention. In one embodiment, in a first paragraph (1), the present invention provides a clip assembly for joining two or more substantially planar structures in a spaced apart manner, the clip assembly comprising: a first clip member comprising an attachment member for attachment to a planar structure, an engagement member attached to the attachment member having first and second engagement arms; and an opening positioned in the engagement member; a second clip member engageable with the first clip member, the second clip member comprising an attachment member for attachment to a second planar structure, an engagement member attached to the attachment member having first and second engagement arms and an opening positioned in the engagement member, the openings of the first and the second clip members being aligned when the clip members are engaged; and a connecting member positioned in the aligned openings of the first and second clip members.

2. The clip assembly of paragraph 1, wherein the attachment member comprises a first longitudinal member and a second longitudinal member.

3. The clip assembly of any of paragraphs 1 or 2, wherein the first and second longitudinal members comprise an attachment arm and a raised arm, wherein the raised arm is in contact with the engagement member and spaces the engagement member a distance from the attachment to the wall panel.

4. The clip assembly of any of paragraphs 1 through 3, wherein the first and second clip members are fastened to the planar structures at the attachment arm of the attachment member.

5. The clip assembly of any of paragraphs 1 through 4, wherein the first clip member includes more than one opening.

6. The clip assembly of any of paragraphs 1 through 5, wherein the engagement arms are planar.

7. The clip assembly of any of paragraphs 1 through 6, wherein the clip members are metal.

8. The clip assembly of any of paragraphs 1 through 7, wherein the clip members comprise a material having a rigidity comparable to metal.

9. The clip assembly of any of paragraphs 1 through 8, wherein the connecting member comprises a rod.

10. The clip assembly of any of paragraphs 1 through 9, wherein the substantially planar structures comprise panels.

11. A hoisting assembly for engaging a hook required to hoist an assembled formwork for a load bearing wall structure comprising: a first hoisting bar receiving plate comprising a metal plate for attachment to a first planar structure, the first hoisting bar having a protruding centered hollow cylinder for engaging a first end of a hoisting bar; a second hoisting bar receiving plate comprising a metal plate for attachment to a second planar structure, the second hoisting bar having a protruding centered hollow cylinder for engaging a second end of the hoisting bar; the hoisting bar placed in contact with the first and second hoisting bar receiving plates, each end of the hoisting bar positioned in contact with each one of the protruding centered hollow cylinders of each hoisting bar receiving plate.

12. A clip assembly comprising: a first clip member having an attachment member and an engagement member, the engagement member having a first engagement arm and a second engagement arm, each engagement arm having an opening; a second clip member having an attachment member and an engagement member, the engagement member having a first engagement arm and a second engagement arm, each engagement arm having an opening, the first and second clip members engageable at the engagement arms so as to align the openings; and a connecting member positioned within the aligned openings of the first and second clip members.

13. The clip assembly of paragraph 12, comprising more than one opening in at least one of the clip members.

14. The clip assembly of either of paragraphs 12 or 13, wherein the first and second clip members have more than one opening.

15. The clip assembly of any of paragraphs 12 through 14, wherein the attachment member comprises a first longitudinal member and a second longitudinal member.

16. The clip assembly of any of paragraphs 12 through 15, wherein the first and second longitudinal members comprise an attachment arm and a raised arm, wherein the raised arm is in contact with the engagement member, spacing the engagement member a distance from a position of attachment.

17. A formwork section for a load bearing wall structure comprising: a first wall panel and a second wall panel; a first clip member attached to the first wall panel, the first clip member having an opening therein; a second clip member attached to the second wall panel, the second clip member having an opening therein, the second clip member being engaged with the first clip member so as to align the opening of the first clip member and the opening of the second clip member; and a connecting member connecting the first and second clip members at the aligned openings.

18. The formwork section of paragraph 17, wherein the connecting member is a rod.

19. The formwork section of either of paragraphs 17 or 18, further comprising an additional structural reinforcement material and two hoisting bar assemblies.

20. The formwork section of any of paragraphs 17 through 19, further comprising concrete between the first and second wall panels.

21. The formwork section of any of paragraphs 17 through 20, wherein the wall panels comprise fiberboard.

22. A clip bracket for a panel assembly comprising: an attachment member for attachment to a panel; a first engaging arm attached to the attachment member and spaced a distance from the panel; a second engaging arm attached to attachment member, parallel with the first engaging arm and spaced a distance from the panel; an opening in the first engaging arm; and an opening in the second engaging arm substantially aligned with the opening in the first engaging arm.

23. The clip bracket of paragraph 22, further comprising an additional opening in at least one of the first and second engaging arms.

24. The clip bracket of paragraph 23, wherein each of the first and second engaging arms comprises an additional opening.

25. The clip bracket of any of paragraphs 22 through 24, further comprising a base member in contact with the attachment member and the first and second engagement arms.

26. The clip bracket of any of paragraphs 22 through 25, wherein the base member comprises an opening.

27. A fully assembled formwork section for a load bearing wall comprising:

a first panel and a second panel; a first clip member attached to the first panel, the first clip member having an attachment member, a first engaging arm and a second engaging arm, the first clip member also comprising an opening; a second clip member attached to the second panel, the second clip member having an attachment member, a first engaging arm, and a second engaging arm, the second clip member also comprising an opening, the second clip member being engaged with the first clip member, wherein the opening of the first clip member and the opening of the second clip member are aligned; a connecting member positioned at the aligned openings of the first and second clip members; a leveling prop connector for attaching a prop for retaining the formwork wall section leveled on a building site; a structural reinforcement material; and a hoisting bar assembly attached to the first and second wall panels.

28. The fully assembled formwork of paragraph 27, wherein a flowable material is added to the formwork section between the first and second wall panels.

29. A wall comprising: a first panel and a second panel; a first clip member attached to the first panel, the first clip member having an attachment member, a first engaging arm and a second engaging arm, the first clip member also comprising an opening; a second clip member attached to the second panel, the second clip member having an attachment member, a first engaging arm, and a second engaging arm, the second clip member also comprising an opening, the second clip member being engaged with the first clip member, wherein the opening of the first clip member and the opening of the second clip member are aligned; a connecting member positioned at the aligned openings of the first and second clip members; and a flowable material in a space between the first panel and the second panel.

30. The wall of paragraph 29, wherein the flowable material comprises concrete.

31. The wall of either of paragraphs 29 or 30, wherein the flowable material surrounds at least a portion of the clip members and connecting member.

32. The wall of any of paragraphs 29 through 31, wherein the connecting member comprises a rod.

33. The wall of any of paragraphs 29 through 32, wherein the panel comprises fiberboard.

34. A method for assembly of a formwork for a load bearing wall comprising:

providing a first panel and a second panel; attaching a first clip member having an engagement member and an opening in the engagement member to the first panel; attaching a second clip member having an engagement member and an opening in the engagement member to the second panel; attaching a leveling prop connector to the first or second panel; attaching additional structural reinforcement material to at least one of the first and second panels; attaching a hoisting bar receiving plate to a wall panel and a hosting bar to the hoisting bar receiving plates; positioning the second panel in an opposed relation to the first panel so that the first and second clip members face each other; moving the first panel towards the second panel, both having attached clip members, into engagement; engaging the first and second clip members at their engagement members; engaging the hoisting bar with the hoisting bar receiving plates; aligning the openings in the engagement members of the first and second clip members; inserting a connecting member into the aligned openings.

35. The method of paragraph 34, wherein a plurality of first clip members, a plurality of second clip members, and a plurality of connecting members are provided.

36. The method of either of paragraphs 34 or 35, further comprising placing a flowable material into a space defined between the first and second panels.

37. The method of any of paragraphs 34 through 36, wherein the flowable material comprises concrete.

38. The method of any of paragraphs 34 through 37, further comprising allowing the concrete to cure, which when hardened forms a wall.

39. The method of any of paragraphs 34 through 38, wherein the connecting member comprises a rod.

Although the present invention has been described with reference to preferred embodiments, persons skilled in the art will recognize that changes may be made in form and detail without departing from the spirit and scope of the invention.

We claim:

1. A formwork section for a load bearing wall structure comprising:

a first wall panel and a second wall panel for assembly in the wall structure;

a first C-shaped clip member attached to the first wall panel, the first clip member having a longitudinal attachment to the first wall panel with a pair of substantially parallel and planar engagement therefrom and having a first pair of spaced, opposed openings defined therein;

a second C-shaped clip member attached to the second wall panel, the second clip member having a longitudinal attachment to the second wall panel with a pair of substantially parallel and planar engagement arms extending therefrom and having a second pair of spaced, opposed openings defined therein, the second clip member being engaged with the first clip member so as to align the first pair of spaced, opposed openings of the first clip member and the second pair of spaced, opposed openings of the second clip member along an insertion axis; and an elongated connecting member connecting the first and second clip members by insertion along the insertion axis and through the aligned first and second pairs of spaced, opposed openings in the first and second clip members.

2. The formwork section of claim 1, wherein the connecting member comprises a rod and the insertion axis is substantially vertical.

3. The formwork section of claim 1, further comprising hoisting bar assemblies coupled to each of the first and second wall panels.

4. The formwork section of claim 1, further comprising concrete between the first and second wall panels.

5. The formwork section of claim 1, wherein the wall panels comprise fiberboard.

6. A wall comprising:

a first panel and a second panel for assembly in the wall;

a first C-shaped clip member attached to the first panel, the first clip member having a pair of longitudinal attachment members attached to a face of the first panel, with a first engaging arm and a second substantially parallel engaging arm extending therefrom, each first clip member arm further comprising an opening to form a first pair of spaced, opposed openings;

a second C-shaped clip member attached to the second panel, the second clip member having a pair of longitudinal attachment members attached to a face of the second panel, with a first engaging arm and a second substantially parallel engaging arm extending therefrom, each second clip member arm further comprising an opening to form a second pair of spaced, opposed openings, the second clip member being engaged with the first clip member, wherein the first pair of spaced, opposed openings on the first clip member and the second pair of spaced, opposed openings on the second clip member are aligned along an insertion axis;

an elongated connecting member positioned by insertion along the insertion axis of the aligned first and second spaced, opposed pairs of openings on the first and second clip members; and a flowable building material in a space between the first panel and the second panel.

7. The wall of claim 6, wherein the flowable material comprises concrete.

8. The wall of claim 6, wherein the flowable material surrounds at least a portion of the clip members and connecting member.

9. The wall of claim 6, wherein the connecting member comprises a rod and the insertion axis is substantially vertical.

10. The wall of claim 6, wherein the panels comprise at least one of concrete, cement and fiber cement.

11. A formwork section for a load bearing wall structure comprising:

an assembly for joining first and second wall panels in a spaced apart manner, the assembly comprising:

a first C-shaped clip member comprising a longitudinal attachment member for attachment to a face of the first wall panel and a pair of generally parallel and planar engagement arms extending therefrom to define a first pair of spaced, opposed openings;

a second C-shaped clip member comprising a longitudinal attachment member for attachment to a face of the second wall panel and a pair of generally parallel and planar engagement arms extending therefrom to define a second pair of spaced, opposed openings;

wherein the first and second clip members are configured for engagement such that the first and second pairs of spaced, opposed openings are aligned along an axis; and a connecting element comprising a rod for insertion along the axis and extending through the first and second aligned pairs of spaced, opposed openings.

12. The formwork section of claim 11, wherein each of the longitudinal attachment members comprises a first longitudinal arm for securing to the face of the respective wall panel and a second longitudinal arm extending therefrom to raise the engagement arms away from the face of the respective wall panel.

13. The formwork section of claim 12, wherein each of the first and second clip members comprises two longitudinal attachment members, with two substantially parallel first longitudinal arms for securing to the respective face of the wall panel and two substantially parallel second arms extending therefrom, the engagement arms extending between the two substantially parallel second arms.

14. The formwork section of claim 12, wherein the axis extends generally parallel to the first and second substantially parallel arms of the longitudinal attachment members.

15. The clip assembly of claim 11, wherein the formwork section comprises a concrete formwork with substantially parallel first and second wall panels defining a space for pouring concrete therebetween.

16. A wall comprising:

first and second opposed, generally parallel wall panels;

a clip assembly comprising first and second C-shaped clip members attached to the first and second wall panels, each of the clip members comprising:

an attachment comprising a pair of longitudinal members attached to a face of the respective first or second wall panel;

an engagement member having first and second substantially parallel planar arms extending from the attachment, each of the aims having an opening to define a pair of substantially aligned spaced openings;

wherein the C-shaped clip members are opposed with their arms engaged, such that the pairs of openings are aligned along an axis; and an elongate connecting member extending along the axis through the aligned pairs of openings, the connecting member connecting the C-shaped clip members to form the wall comprising the first and second wall panels.

17. A structural formwork comprising the wall of claim 16, wherein the first and second wall panels are connected by a plurality of the clip assemblies to form the structural formwork with a space therebetween.

18. The structural formwork of claim 17, further comprising concrete in the space between the first and second wall panels.

19. A foundation wall comprising the structural formwork of claim 18.

20. A formwork section for a load bearing wall structure comprising:

a panel assembly comprising first and second opposed, spaced, generally parallel wall panels;

a clip bracket assembly for assembling the panel assembly, the clip bracket assembly comprising:

a first C-shaped bracket comprising a longitudinal attachment to a face of the first wall panel and a pair of generally parallel and planar engagement arms extending therefrom to define a first pair of substantially aligned, spaced openings;

a second C-shaped bracket comprising a longitudinal attachment to a face of the second wall panel and a pair of generally parallel and planar engagement arms extending therefrom to define a second pair of substantially aligned, spaced openings; and a connecting rod extending along an axis through the first and second pairs of substantially aligned, spaced openings, wherein the first and second pairs of openings are substantially aligned along the axis.

21. The formwork section of claim 20, wherein each of the longitudinal attachments comprises two substantially parallel longitudinal members secured to the face of the respective wall panel, such that the pairs of engagement arms extend therebetween for engagement between the spaced wall panels.

22. The formwork section of claim 21, wherein the pairs of engagement arms are spaced from the face of the respective wall panel by the substantially parallel longitudinal members.

23. The formwork section of 21, wherein the axis through the first and second pairs of openings is substantially aligned along the two longitudinal members.

* * * * *

UNITED STATES PATENT AND TRADEMARK OFFICE

CERTIFICATE OF CORRECTION

PATENT NO. : 8,468,764 B2
APPLICATION NO. : 13/170980
DATED : June 25, 2013
INVENTOR(S) : Degen et al.

It is certified that error appears in the above-identified patent and that said Letters Patent is hereby corrected as shown below:

SPECIFICATION

| Column | Line | PTO | Should Read |
|---|---|---|---|
| 5 | 17 | "first engaging arm 58, 58' forming" | --first engaging arm 58, 58', forming-- |

CLAIMS

| Column | Line | PTO | Should Read |
|---|---|---|---|
| 14 | 26 | "and planar engagement therefrom" | --and planar engagement arms extending therefrom-- |
| 16 | 11 | "each of the aims having an opening" | --each of the arms having an opening-- |

Signed and Sealed this
Tenth Day of September, 2013

Teresa Stanek Rea

Teresa Stanek Rea
*Acting Director of the United States Patent and Trademark Office*